US011482790B2

(12) United States Patent
Polidore et al.

(10) Patent No.: US 11,482,790 B2
(45) Date of Patent: Oct. 25, 2022

(54) DIELECTRIC LENS AND ELECTROMAGNETIC DEVICE WITH SAME

(71) Applicant: Rogers Corporation, Chandler, AZ (US)

(72) Inventors: Trevor Polidore, Scottsdale, AZ (US); Sergio Clavijo, Phoenix, AZ (US); Dirk Baars, Phoenix, AZ (US); John Sanford, Escondido, CA (US)

(73) Assignee: ROGERS CORPORATION, Chandler, AZ (US)

( * ) Notice: Subject to any disclaimer, the term of this patent is extended or adjusted under 35 U.S.C. 154(b) by 0 days.

(21) Appl. No.: 17/216,989

(22) Filed: Mar. 30, 2021

(65) Prior Publication Data

US 2021/0328356 A1 Oct. 21, 2021

Related U.S. Application Data

(60) Provisional application No. 63/006,976, filed on Apr. 8, 2020.

(51) Int. Cl.
*H01Q 9/04* (2006.01)
*H01Q 15/08* (2006.01)
*H01Q 3/30* (2006.01)

(52) U.S. Cl.
CPC ..... *H01Q 15/08* (2013.01); *H01Q 3/30* (2013.01)

(58) Field of Classification Search
CPC ..... H01Q 9/04; H01Q 9/0485; H01Q 15/02; H01Q 15/06; H01Q 15/08; H01Q 1/38; H01Q 3/30; H01Q 19/06
See application file for complete search history.

(56) References Cited

U.S. PATENT DOCUMENTS 2,624,002 A 10/1952 Bouix
3,212,454 A 10/1965 Ringenbach
(Continued)

FOREIGN PATENT DOCUMENTS

CN 104037505 A 9/2014
CN 110380230 A * 10/2019 ..... G06F 17/5009
(Continued)

OTHER PUBLICATIONS

Buerkle, A. et al; "Fabrication of a DRA Array Using Ceramic Stereolithography"; IEEE Antennas and Wireless Popagation Letters; IEEE; vol. 5,, No. 1, Jan. 2007; pp. 479-481.
(Continued)

*Primary Examiner* — Tho G Phan
(74) *Attorney, Agent, or Firm* — Cantor Colburn LLP

(57) ABSTRACT

A dielectric lens, includes: a three-dimensional, 3D, body of dielectric material having a spatially varying dielectric constant, Dk; the 3D body having at least three regions R(i) with local maxima of dielectric constant values Dk(i) relative to surrounding regions of respective ones of the at least three regions R(i), locations of the at least three regions R(i) being defined by local coordinates of: azimuth angle(i), zenith angle(i), and radial distance(i), relative to a particular common point of origin associated with the 3D body, where (i) is an index that ranges from 1 to at least 3; wherein the spatially varying Dk of the 3D body is configured to vary as a function of the zenith angle between a first region R(1) and a second region R(2) at a given azimuth angle and a given radial distance.

19 Claims, 11 Drawing Sheets

(56) References Cited

U.S. PATENT DOCUMENTS 3,255,453 A 6/1966 Horst
3,321,765 A 5/1967 Peters et al.
3,321,821 A * 5/1967 Horst ..... H01Q 15/08 264/108
4,274,097 A 6/1981 Krall et al.
4,288,795 A * 9/1981 Shelton ..... H01Q 21/0006 343/754
4,366,484 A 12/1982 Weiss et al.
4,458,249 A * 7/1984 Valentino ..... H01Q 25/008 343/754
4,575,330 A 3/1986 Hull
4,743,915 A 5/1988 Rammos et al.
4,929,402 A 5/1990 Hull
5,104,592 A 4/1992 Hull et al.
5,184,307 A 2/1993 Hull et al.
5,192,559 A 3/1993 Hull et al.
5,227,749 A 7/1993 Raguenet et al.
5,234,636 A 8/1993 Hull et al.
5,236,637 A 8/1993 Hull
5,273,691 A 12/1993 Hull et al.
5,453,754 A 9/1995 Fray
5,476,749 A 12/1995 Steinmann et al.
5,589,842 A 12/1996 Wang et al.
5,667,796 A 9/1997 Otten
5,677,796 A 10/1997 Zimmerman et al.
5,828,271 A 10/1998 Stitzer
5,854,608 A 12/1998 Leisten
5,867,120 A 2/1999 Ishikawa et al.
5,940,036 A 8/1999 Oliver et al.
5,943,005 A 8/1999 Tanizaki et al.
5,952,972 A 9/1999 Ittipiboon et al.
6,008,755 A 12/1999 Ishikawa et al.
6,031,433 A 2/2000 Tanizaki et al.
6,052,087 A 4/2000 Ishikawa et al.
6,061,026 A 5/2000 Ochi et al.
6,061,031 A 5/2000 Cosenza et al.
6,075,485 A 6/2000 Lilly et al.
6,075,492 A 6/2000 Schmidt et al.
6,133,887 A 10/2000 Tanizaki et al.
6,147,647 A 11/2000 Tassoudji et al.
6,181,297 B1 1/2001 Leisten
6,188,360 B1 2/2001 Kato et al.
6,198,450 B1 3/2001 Adachi et al.
6,268,833 B1 7/2001 Tanizaki et al.
6,292,141 B1 9/2001 Lim
6,314,276 B1 11/2001 Hilgers et al.
6,317,095 B1 11/2001 Teshirogi et al.
6,323,808 B1 11/2001 Heinrichs et al.
6,323,824 B1 11/2001 Heinrichs et al.
6,344,833 B1 2/2002 Lin et al.
6,373,441 B1 4/2002 Porath et al.
6,437,747 B1 8/2002 Stoiljkovic et al.
6,476,774 B1 11/2002 Davidson et al.
6,528,145 B1 3/2003 Berger et al.
6,552,687 B1 4/2003 Rawnick et al.
6,556,169 B1 4/2003 Fukuura et al.
6,621,381 B1 9/2003 Kundu et al.
6,743,744 B1 6/2004 Kim et al.
6,794,324 B1 9/2004 Kim et al.
6,816,118 B2 11/2004 Kingsley et al.
6,816,128 B1 11/2004 Jennings
6,855,478 B2 2/2005 DeVoe et al.
7,161,535 B2 1/2007 Palmer et al.
7,179,844 B2 2/2007 Aki et al.
7,183,975 B2 2/2007 Thomas et al.
7,196,663 B2 3/2007 Bozer et al.
7,253,789 B2 8/2007 Kingsley et al.
7,279,030 B2 10/2007 Kurowski
7,292,204 B1 11/2007 Chang et al.
7,310,031 B2 12/2007 Pance et al.
7,355,560 B2 * 4/2008 Nagai ..... H01Q 15/08 343/911 R
7,379,030 B1 5/2008 Lier
7,382,322 B1 6/2008 Yang et al.
7,405,698 B2 7/2008 De Rochemont
7,443,363 B2 10/2008 Ying
7,498,969 B1 3/2009 Paulsen et al.
7,534,844 B2 5/2009 Lee et al.
7,545,327 B2 6/2009 Iellici et al.
7,550,246 B2 6/2009 Fukuzumi et al.
7,570,219 B1 8/2009 Paulsen et al.
7,595,765 B1 9/2009 Hirsch et al.
7,636,063 B2 12/2009 Channabasappa
7,649,029 B2 1/2010 Kolb et al.
7,663,553 B2 2/2010 Chang et al.
7,688,263 B1 3/2010 Oxley
7,710,325 B2 5/2010 Cheng
7,767,728 B2 8/2010 Lu et al.
7,796,080 B1 9/2010 Lynch et al.
7,824,839 B2 11/2010 Ober et al.
7,835,600 B1 11/2010 Yap et al.
7,876,283 B2 1/2011 Bouche et al.
7,935,476 B2 5/2011 Teng
7,961,148 B2 6/2011 Goldberger
8,018,397 B2 9/2011 Jow et al.
8,098,187 B1 1/2012 Lynch et al.
8,098,197 B1 1/2012 Herting et al.
8,119,214 B2 2/2012 Schwantes et al.
8,232,043 B2 7/2012 Williamson et al.
8,497,804 B2 7/2013 Haubrich et al.
8,498,539 B1 7/2013 Iichenko et al.
8,736,502 B1 5/2014 Langfield et al.
8,773,319 B1 7/2014 Anderson et al.
8,902,115 B1 12/2014 Loui et al.
9,112,273 B2 8/2015 Christie et al.
9,184,697 B2 11/2015 Sekiguchi et al.
9,205,601 B2 12/2015 Desimone et al.
9,225,070 B1 12/2015 Zeweri et al.
9,455,488 B2 9/2016 Chirila
9,608,330 B2 3/2017 Singleton et al.
9,825,373 B1 11/2017 Smith
9,917,044 B2 3/2018 Zhou et al.
9,930,668 B2 3/2018 Barzegar et al.
10,355,361 B2 7/2019 Pance et al.
10,476,164 B2 11/2019 Pance et al.
10,522,917 B2 12/2019 Pance et al.
10,587,039 B2 3/2020 Pance et al.
10,601,137 B2 3/2020 Pance et al.
11,108,159 B2 8/2021 Pance et al.
2001/0013842 A1 8/2001 Ishikawa et al.
2001/0043158 A1 11/2001 Adachi et al.
2002/0000947 A1 1/2002 Al-Rawi et al.
2002/0057138 A1 5/2002 Takagi et al.
2002/0067317 A1 6/2002 Sakurada
2002/0180646 A1 12/2002 Kivekas et al.
2002/0196190 A1 12/2002 Lim
2003/0016176 A1 1/2003 Kingsley et al.
2003/0034922 A1 2/2003 Isaacs et al.
2003/0043075 A1 3/2003 Bit-Babik et al.
2003/0043086 A1 3/2003 Schaffner
2003/0122729 A1 7/2003 Diaz et al.
2003/0151548 A1 8/2003 Kingsley et al.
2003/0181312 A1 9/2003 Mailadil et al.
2004/0029709 A1 2/2004 Oba et al.
2004/0029985 A1 2/2004 Aki et al.
2004/0036148 A1 2/2004 Block et al.
2004/0051602 A1 3/2004 Pance et al.
2004/0080455 A1 4/2004 Lee
2004/0113843 A1 6/2004 Le Bolzer et al.
2004/0119646 A1 6/2004 Ohno et al.
2004/0127248 A1 7/2004 Lin et al.
2004/0130489 A1 7/2004 Le Bolzer et al.
2004/0155817 A1 8/2004 Kingsley et al.
2004/0233107 A1 11/2004 Popov et al.
2004/0257176 A1 12/2004 Pance et al.
2004/0263422 A1 12/2004 Lynch
2005/0017903 A1 1/2005 Ittipiboon et al.
2005/0024271 A1 2/2005 Ying et al.
2005/0057402 A1 3/2005 Ohno et al.
2005/0099348 A1 5/2005 Pendry
2005/0122273 A1 6/2005 Legay et al.
2005/0162316 A1 7/2005 Thomas et al.
2005/0162733 A1 7/2005 Cho et al.
2005/0179598 A1 8/2005 Legay et al.

(56) References Cited

U.S. PATENT DOCUMENTS

2005/0200531 A1 9/2005 Huang et al.
2005/0219130 A1 10/2005 Koch et al.
2005/0225499 A1 10/2005 Kingsley et al.
2005/0242996 A1 11/2005 Palmer et al.
2005/0264449 A1 12/2005 Strickland
2005/0264451 A1 12/2005 Aikawa et al.
2005/0264452 A1 12/2005 Fujishima et al.
2006/0022875 A1 2/2006 Pidwerbetsky et al.
2006/0119518 A1 6/2006 Ohmi et al.
2006/0145705 A1 7/2006 Raja
2006/0194690 A1 8/2006 Osuzu
2006/0220958 A1 10/2006 Saegrov
2006/0232474 A1 10/2006 Fox
2006/0293651 A1 12/2006 Cronin
2007/0067058 A1 3/2007 Miyamoto et al.
2007/0152884 A1 7/2007 Bouche et al.
2007/0164420 A1 7/2007 Chen et al.
2007/0252778 A1 11/2007 Ide et al.
2008/0036675 A1 2/2008 Fujieda
2008/0042903 A1 2/2008 Cheng
2008/0048915 A1 2/2008 Chang et al.
2008/0079182 A1 4/2008 Thompson et al.
2008/0094309 A1 4/2008 Pance et al.
2008/0122703 A1 5/2008 Ying
2008/0129616 A1 6/2008 Li et al.
2008/0129617 A1 6/2008 Li et al.
2008/0019195 A1 8/2008 Tokoro et al.
2008/0193749 A1 8/2008 Thompson et al.
2008/0260323 A1 10/2008 Jalali et al.
2008/0272963 A1 11/2008 Chang et al.
2008/0278378 A1 11/2008 Chang et al.
2009/0040131 A1 2/2009 Mosallaei
2009/0073332 A1 3/2009 Irie
2009/0102739 A1 4/2009 Chang et al.
2009/0128262 A1 5/2009 Lee et al.
2009/0128434 A1 5/2009 Chang et al.
2009/0140944 A1 6/2009 Chang et al.
2009/0153403 A1 6/2009 Chang et al.
2009/0179810 A1 7/2009 Kato et al.
2009/0184875 A1 7/2009 Chang et al.
2009/0206957 A1 8/2009 Hiroshima et al.
2009/0262022 A1 10/2009 Ying
2009/0270244 A1 10/2009 Chen et al.
2009/0305652 A1 12/2009 Boffa et al.
2010/0002312 A1 1/2010 Duparre et al.
2010/0051340 A1 3/2010 Yang et al.
2010/0103052 A1 4/2010 Ying
2010/0156754 A1 6/2010 Kondou
2010/0220024 A1 9/2010 Snow et al.
2010/0231452 A1 9/2010 Babakhani et al.
2011/0012807 A1 1/2011 Sorvala
2011/0050367 A1 3/2011 Yen et al.
2011/0121258 A1 5/2011 Hanein et al.
2011/0122036 A1 5/2011 Leung et al.
2011/0133991 A1 6/2011 Lee et al.
2011/0204531 A1 8/2011 Hara et al.
2011/0248890 A1 10/2011 Lee et al.
2012/0045619 A1 2/2012 Ando et al.
2012/0092219 A1 4/2012 Kim
2012/0212386 A1 8/2012 Massie et al.
2012/0242553 A1 9/2012 Leung et al.
2012/0245016 A1 9/2012 Curry et al.
2012/0256796 A1 10/2012 Leiba
2012/0274523 A1 11/2012 Ayatollahi
2012/0276311 A1 11/2012 Chirila
2012/0280380 A1 11/2012 Kamgaing
2012/0287008 A1 11/2012 Kim
2012/0306713 A1 12/2012 Raj et al.
2012/0329635 A1 12/2012 Hill
2013/0076570 A1 3/2013 Lee et al.
2013/0088396 A1 4/2013 Han
2013/0113674 A1 5/2013 Ryu
2013/0120193 A1 5/2013 Hoppe et al.
2013/0234898 A1 9/2013 Leung et al.
2013/0278610 A1 10/2013 Stephanou et al.
2014/0043189 A1 2/2014 Lee et al.
2014/0091103 A1 4/2014 Neitzel
2014/0327591 A1 11/2014 Kokkinos
2014/0327597 A1 11/2014 Rashidian et al.
2015/0035714 A1 2/2015 Zhou
2015/0070230 A1 3/2015 Bradley et al.
2015/0077198 A1 3/2015 Yatabe
2015/0138036 A1 4/2015 Harper
2015/0183167 A1 7/2015 Molinari et al.
2015/0207233 A1 7/2015 Kim et al.
2015/0207234 A1 7/2015 Ganchrow et al.
2015/0236428 A1 8/2015 Caratelli et al.
2015/0244082 A1 8/2015 Caratelli et al.
2015/0266244 A1 9/2015 Page
2015/0303546 A1 10/2015 Rashidian et al.
2015/0314526 A1 11/2015 Cohen
2015/0346334 A1 12/2015 Nagaishi et al.
2015/0380824 A1 12/2015 Tayfeh Aligodarz et al.
2016/0036132 A1 2/2016 Rumpf et al.
2016/0107290 A1 4/2016 Bajaj et al.
2016/0111769 A1 4/2016 Pance et al.
2016/0218437 A1 7/2016 Guntupalli et al.
2016/0219976 A1 8/2016 Guyan
2016/0294066 A1 10/2016 Djerafi et al.
2016/0294068 A1 10/2016 Djerafi et al.
2016/0313306 A1 10/2016 Ingber et al.
2016/0314431 A1 10/2016 Quezada
2016/0322708 A1 11/2016 Tayfeh Aligodarz et al.
2016/0351996 A1 12/2016 Ou
2016/0372955 A1 12/2016 Fackelmeier et al.
2017/0018851 A1 1/2017 Henry et al.
2017/0040700 A1 2/2017 Leung et al.
2017/0062944 A1 3/2017 Zimmerman et al.
2017/0125901 A1 5/2017 Sharawi et al.
2017/0125908 A1 5/2017 Pance et al.
2017/0125909 A1 5/2017 Pance et al.
2017/0125910 A1 5/2017 Pance et al.
2017/0179569 A1 6/2017 Kim et al.
2017/0188874 A1 7/2017 Suhami
2017/0201026 A1 7/2017 Werner et al.
2017/0225395 A1 8/2017 Boydston et al.
2017/0256847 A1 9/2017 Vollmer et al.
2017/0271772 A1 9/2017 Miraftab et al.
2017/0272149 A1 9/2017 Michaels
2017/0324171 A1 11/2017 Shehan
2017/0360534 A1 12/2017 Sun
2018/0054234 A1 2/2018 Stuckman et al.
2018/0069594 A1 3/2018 Henry et al.
2018/0090815 A1 3/2018 Shirinfar et al.
2018/0115072 A1 4/2018 Pance et al.
2018/0183150 A1 6/2018 Sienkiewicz et al.
2018/0241129 A1 8/2018 Pance et al.
2018/0282550 A1 10/2018 Burgess et al.
2018/0309202 A1 10/2018 Pance et al.
2018/0323514 A1 11/2018 Pance et al.
2019/0020105 A1 1/2019 Pance et al.
2019/0115668 A1* 4/2019 Coward ..... H01Q 15/02
2019/0128624 A1 5/2019 Cohen et al.
2019/0214732 A1 7/2019 Leung et al.
2019/0221926 A1 7/2019 Pance et al.
2019/0221939 A1 7/2019 George et al.
2019/0221940 A1 7/2019 Pance et al.
2019/0319357 A1 10/2019 Pance et al.
2019/0319358 A1 10/2019 Pance et al.
2019/0379123 A1 12/2019 Leung et al.
2019/0393607 A1 12/2019 Pance et al.
2020/0083602 A1 3/2020 Sethumadhavan et al.
2020/0083609 A1 3/2020 Pance et al.
2020/0083610 A1 3/2020 Pance et al.
2020/0099136 A1 3/2020 Pance et al.
2020/0122387 A1 4/2020 Polidore et al.
2020/0194881 A1 6/2020 Pance et al.
2020/0227827 A1 7/2020 Vollmer et al.
2021/0328356 A1 10/2021 Polidore et al.

FOREIGN PATENT DOCUMENTS

CN 216288983 U * 4/2022
EP 0468413 A2 1/1992

(56) References Cited

FOREIGN PATENT DOCUMENTS

| | | | | |
|---|---|---|---|---|
| EP | 0587247 | A1 | 3/1994 | |
| EP | 0801436 | A2 | 10/1997 | |
| EP | 1783516 | A1 | 5/2007 | |
| EP | 2905632 | A1 | 8/2015 | |
| GB | 2050231 | A | 1/1981 | |
| JP | H0665334 | A | 3/1994 | |
| JP | 2004112131 | A | 4/2004 | |
| JP | 2013211841 | A | 10/2010 | |
| RU | 2660385 | | 7/2018 | |
| WO | 9513565 | A1 | 5/1995 | |
| WO | WO-0076028 | A1 * | 12/2000 | ..... G02B 3/0087 |
| WO | 2012129968 | A1 | 10/2012 | |
| WO | 2014100462 | A1 | 6/2014 | |
| WO | 2014126837 | A2 | 8/2014 | |
| WO | 2015102938 | A1 | 7/2015 | |
| WO | 2016153711 | A1 | 9/2016 | |
| WO | 2017040883 | A1 | 3/2017 | |
| WO | 2017075177 | A1 | 5/2017 | |
| WO | 2017075184 | A1 | 5/2017 | |
| WO | 2017090401 | A1 | 6/2017 | |
| WO | 2018010443 | A1 | 1/2018 | |
| WO | 2017075186 | A1 | 5/2018 | |
| WO | 2018226657 | A1 | 12/2018 | |

OTHER PUBLICATIONS

Guo, Yomg-Xin, et al.,; "Wide-Band Stacked Double Annular-Ring Dielectric Resonator Antenna at the End-Fire Mode Operation"; IEEE Transacions on Antennas and Propagation; vol. 53; No. 10; Oct. 2005; 3394-3397 pages.

Kakade, A.B., et al; "Analysis of the Rectangular Waveguide Slot Coupled Multilayer hemispherical Dielectric Resonator Antenna"; IET Microwaves, Antennas & Propagation, The Institution of Engineering and Technology; vol. 6; No. 3; Jul. 11, 2011; 338-347 pages.

Kakade, Anandrao, et al.; Mode Excitation in the Coaxial Probe Coupled Three-Layer Hemispherical Dielectric Resonator Antenna; IEEE Transactions on Antennas and Propagation; vol. 59; No. 12; Dec. 2011; 7 pages.

Kishk, A. Ahmed, et al.,; "Analysis of Dielectric-Resonator with Emphasis on Hemispherical Structures"; IEEE Antennas & Propagation Magazine; vol. 36; No. 2; Apr. 1994; 20-31 pages.

Petosa, Aldo, et al.; "Dielectric Resonator Antennas: A Historical Review and the Current State of the Art"; IEEE Antennas and Propagation Magazine; vol. 52, No. 5, Oct. 2010; 91-116 pages.

Raghvendra Kumar Chaudhary et al; Variation of Permittivity in Radial Direction in Concentric Half-Split Cylindrical Dielectric Resonator Antenna for Wideband Application: Permittivity Variation in R-Dir. in CDRA; International Journal of RF and Microwave Computer-Aided Engineering; vol. 25; No. 4; May 1, 2015; pp. 321-329.

Ruan, Yu-Feng, et al; "Antenna Effects Consideration for Space-Time Coding UWB-Impulse Radio System in IEEE 802.15 Multipath Channel"; Wireless Communications, Networking and Mobile Computing; 2006; 1-4 pages.

Wong, Kin-Lu, et al.,; "Analysis of a Hemispherical Dielectric Resonator Antenna with an Airgap"; IEEE Microwave and Guided Wave Letters; vol. 3; No. 9; Oct. 3, 1993; 355-357 pages.

Zainud-Deen, S H et al; "Dielectric Resonator Antenna Phased Array for Fixed RFID Reader in Near Field Region"; IEEE; Mar. 6, 2012; pp. 102-107.

Zhang Shiyu et al.; "3D-Printed Graded Index Lenses for RF Applications"; ISAP 2016 International Symposium on Antennas and Propagation, Okinawa, Japan.; pp. 1-27.

Zainud-Deen SH et al: "High Directive Dielectric resonator antenna over curved ground plane using metamaterials", National Radio Science Conference IEEE, Apr. 26, 2011 pp. 1-9.

"New 3D Printed Electromagnetic Lense from OmniPreSense"; URL: http://www.microwavejournal.com/articles/31133-new-3d-printed-electromagnetic-lens-from-omnipresense; Date of Access: Oct. 16, 2018; 8 pages.

"Photoacid Generator Selection Guide for the electronics industry and energy curable coatings" (BASF 2010).

Atabak Rashidian et al; "Photoresist-Based Polymer Resonator Antennas: Lithography Fabrication, Strip-Fed Excitation, and Multimode Operation", IEEE Antennas and Propagation Magazine, IEEE Service Center; vol. 53, No. 4, Aug. 1, 2011; 16-27 pages.

Boriskin et al. "Integrated Lens Antennas" In: "Aperture Antennas for Millimeter and Sub-Millimeter Wave Applications", Sep. 8, 2017, International Publishing, pp. 3-36.

Elboushi A. et al., "High Gain Hybrid DRA/Horn antenna for MMW Applications", Concordia Universitiy; 2014 IEEE; 2 pages.

Hesselbarth et al., "Millimeter-wave front-end integration concept using beam-switched lens antenna", 2016 10th European Conference on Antennas and Propagation, European Assoc. of Antennas and Propagation, Apr. 10, 2016; pp. 1-5.

Keysight Technologies; "Split Post Dielectric Resonators for Dielectric Measurements of Substrates"; Keysight Technologies, Dec. 2, 2017; 5989-5384EN, pp. 1-11.

Krupka et al.; "Split post dielectric resonator technique for precise measurements of laminar dielectric specimens—Measurement uncertainties"; IEEE Xplore Conference Paper Feb. 2000, pp. 305-308.

Krupka J., Gregory A.P., Rochard O.C., Clarke R.N., Riddle B., Baker-Jarvis J., Uncertainty of Complex Permittivity Measurement by Split-Post Dielectric Resonator Techniques, Journal of the European Ceramic Society, No. 10, pp. 2673-2676, 2001.

Krupka, J., Geyer, R.G., Baker-Jarvis, J., Ceremuga, J., Measurements of the complex permittivity of microwave circuit board substrates using split dielectric resonator and reentrant cavity tech¬niques, Seventh International Conference on Dielectric Materials, Measurements and Applications, (Conf. Publ. No. 430), pp. 21-24, Sep. 1996.

Lei, Juan et al., "Experimental demonstration of conformal phased array antenna via transformation optics," Scientific Reports, vol. 8, No. 1, Feb. 28, 2018, 14 pages.

Liang, M. et al.; "A 3-D Luneburg lens antenna fabricated by polymer jetting rapid prototyping," IEEE Transactions on Antennas and Propagation, 62(4), Apr. 2014, 1799-1807.

Tang, W. et al., "Discrete Coordinate Transformation for Designing All-Dielectric Flat Antennas", IEEE Transactions on Antennas and Propagation, vol. 58, No. 12, Dec. 2010 pp. 3795-3804.

Thornton et al., "Introduction" In: "Modern Lens Antennas for Communications Engineering", Jan. 1, 2013 John Wiley & Sons, Inc. pp. 1-48.

* cited by examiner

DIELECTRIC LENS AND ELECTROMAGNETIC DEVICE WITH SAME

CROSS REFERENCE TO RELATED APPLICATIONS

This application claims the benefit of U.S. Provisional Application Ser. No. 63/006,976, filed Apr. 8, 2020, which is incorporated herein by reference in its entirety.

BACKGROUND

The present disclosure relates generally to a dielectric lens, particularly to a dielectric lens having at least three distinct focusing or defocusing sections, and more particularly to an electromagnetic, EM, device having a phased array antenna arranged and configured for EM communication with a dielectric lens having at least three distinct focusing or defocusing sections.

Phased array antennas are useful for steering an EM wavefront in one or two directions along a direction of propagation of EM radiation. In a typical planar phased array, the steering capability may be limited due to the effective aperture decreasing as the steering angle increases. To improve the steering capability, existing systems have employed more phased array antenna base station segments, and/or Luneburg lenses. As will be appreciated, an increase in the number of phased array antenna base station segments results in additional cost and hardware real estate, and the use of Luneburg lenses requires the use of non-planar arrays.

While existing EM phased array communication systems may be suitable for their intended purpose, the art relating to such systems would be advanced with a dielectric lens, or combination of dielectric lens and phased array antenna that overcomes the drawbacks of the existing art.

BRIEF SUMMARY

An embodiment includes a dielectric lens having: a three-dimensional, 3D, body of dielectric material having a spatially varying dielectric constant, Dk; the 3D body having at least three regions R(i) with local maxima of dielectric constant values Dk(i) relative to surrounding regions of respective ones of the at least three regions R(i), locations of the at least three regions R(i) being defined by local coordinates of: azimuth angle(i), zenith angle(i), and radial distance(i), relative to a particular common point of origin associated with the 3D body, where (i) is an index that ranges from 1 to at least 3; wherein the spatially varying Dk of the 3D body is configured to vary as a function of the zenith angle between a first region R(1) and a second region R(2) at a given azimuth angle and a given radial distance.

An embodiment includes a dielectric lens having: a three-dimensional, 3D, body of dielectric material having a spatially varying Dk that varies along at least three different rays having different directions and a particular common point of origin, from the particular common point of origin to an outer surface of the 3D body, the particular common point of origin being enveloped by the 3D body; wherein the at least three different rays define locations of corresponding ones of at least three regions R(i) of the 3D body with local maxima of dielectric constant values Dk(i) relative to the dielectric material of immediate surrounding regions of corresponding ones of the at least three regions R(i), where (i) is an index that ranges from 1 to at least 3; wherein the dielectric material of the 3D body has a spatially varying Dk from each of the at least three regions R(i) to any other one of the at least three regions R(i) along any path within the 3D body.

An embodiment includes an electromagnetic, EM, device having: a phased array antenna; and a dielectric lens according to any one of the foregoing lenses; wherein the respective dielectric lens is configured and disposed to be in EM communication with the phased array antenna when electromagnetically excited.

The above features and advantages and other features and advantages of the invention are readily apparent from the following detailed description of the invention when taken in connection with the accompanying drawings.

BRIEF DESCRIPTION OF THE DRAWINGS

Referring to the exemplary non-limiting drawings wherein like elements are numbered alike in the accompanying Figures.

DETAILED DESCRIPTION

Although the following detailed description contains many specifics for the purposes of illustration, anyone of ordinary skill in the art will appreciate that many variations and alterations to the following details are within the scope of the appended claims. Accordingly, the following example embodiments are set forth without any loss of generality to, and without imposing limitations upon, the claimed invention disclosed herein.

An embodiment, as shown and described by the various figures and accompanying text, provides a three-dimensional, 3D, dielectric lens having at least three distinct focusing or defocusing sections strategically located within the body of the lens that are structurally and electromagnetically configured to cooperate with a phased array antenna for facilitating beam steering of an EM wavefront +/−90 degrees relative to a direction of propagation of the EM radiation wavefront, which provides for increased signal coverage without the need for increased base station segments. Each of the at least three distinct focusing/defocusing sections of the 3D dielectric lens are formed by corresponding regions having a local maxima of dielectric constant, Dk, values, which is discussed in detail below. As used herein the term dielectric lens means a 3D body of dielectric material that serves to alter the spatial distribution of radiated EM energy, and as disclosed herein more particularly serves to alter the spatial distribution of radiated EM energy via the at least three focusing/defocusing sections, as opposed to serving as a radiating antenna per se.

While embodiments described or illustrated herein may depict a particular geometry or analytical model as an exemplary dielectric lens, it will be appreciated that an embodiment disclosed herein is also applicable to other geometries or structures suitable for a purpose disclosed herein and falling within an ambit of the appended claims. As such, it should be appreciated that the illustrations provided herewith are for illustration purposes only and should not be construed as the only constructs possible for a purpose disclosed herein. For example, several figures described herein below refer to an example analytical block element 104 (see FIG. 4A), which is for illustration purposes only and not to be construed as a limitation, as it is contemplated that the appended claims also encompass a dielectric lens construct having a gradual rather than a step-wise transition of dielectric constants from one region of the lens to another region of the lens. All constructs falling within an ambit of the appended claims are contemplated and considered to be inherently if not explicitly disclosed herein.

Figure 1:
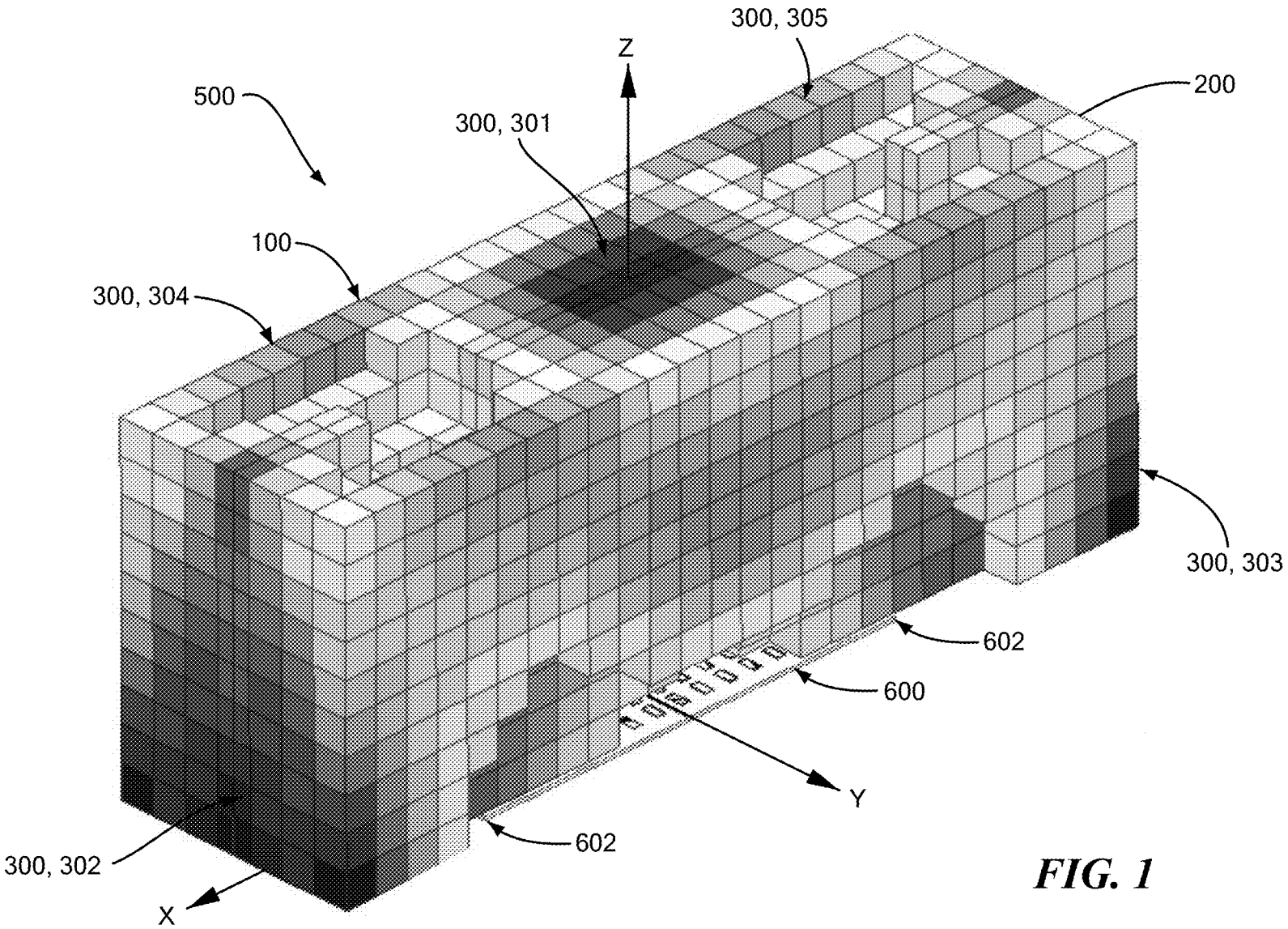
FIG. 1 depicts a rotated isometric view of a 3D block diagram analytical model of a dielectric lens representative of an example lens positioned above an example phased array antenna, in accordance with an embodiment.
Figure 2A:
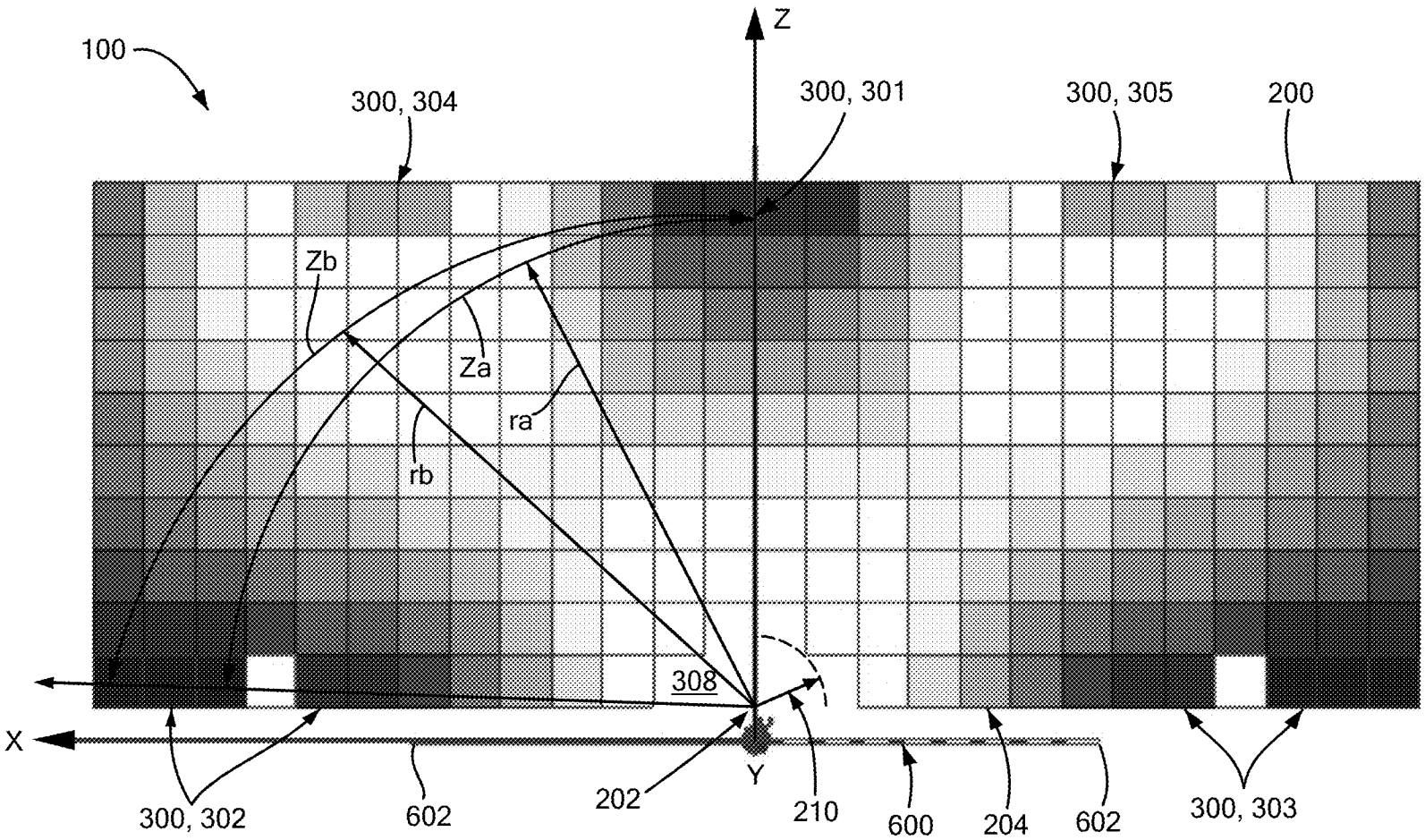
FIGS. 2A and 2B depict a front cross section view of the embodiment of FIG. 1 cut through the x-z plane, in accordance with an embodiment.
Figure 2B:
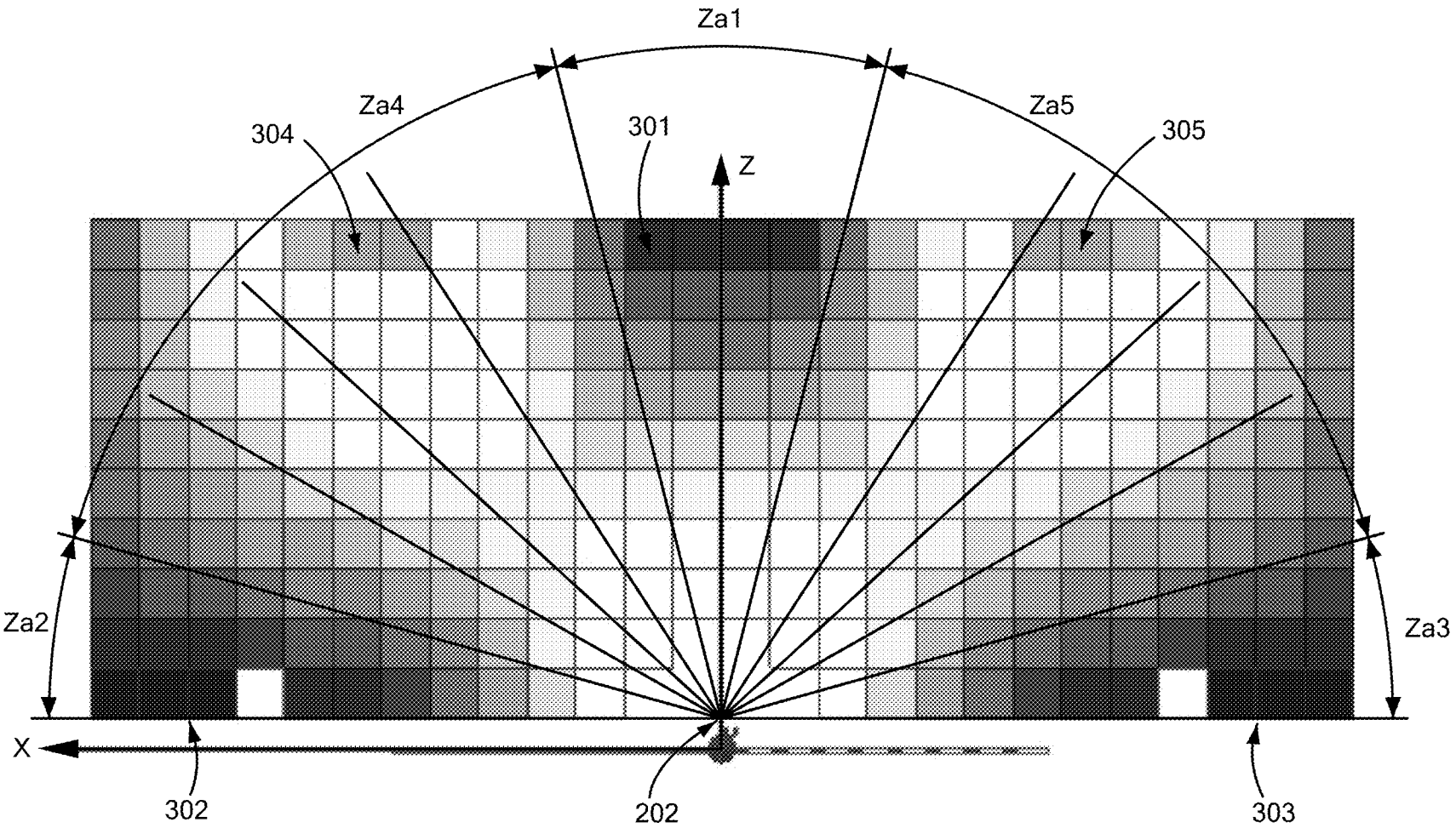
Figure 3:
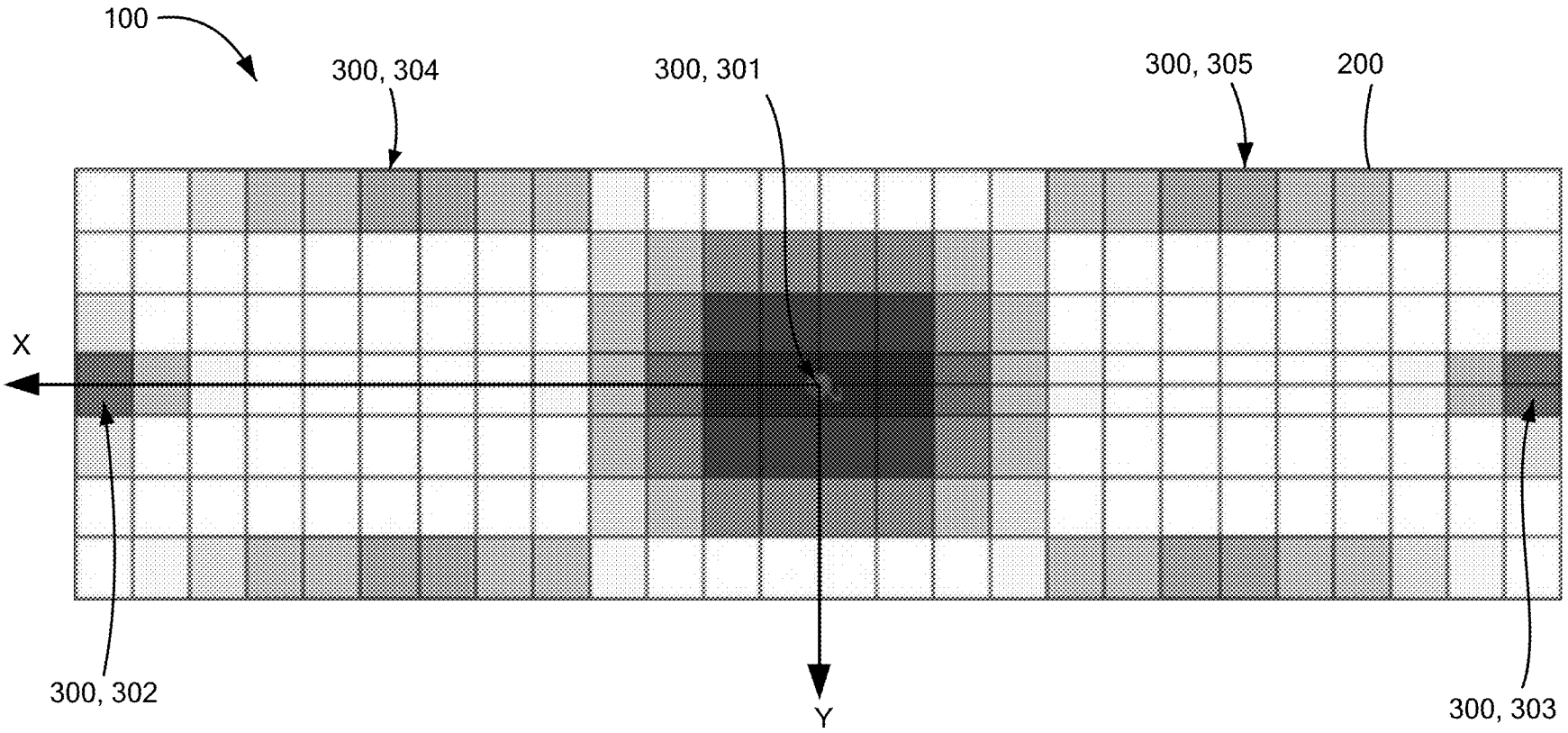
FIG. 3 depicts a top down plan view of the embodiment of FIG. 1, in accordance with an embodiment.
Figure 4A:
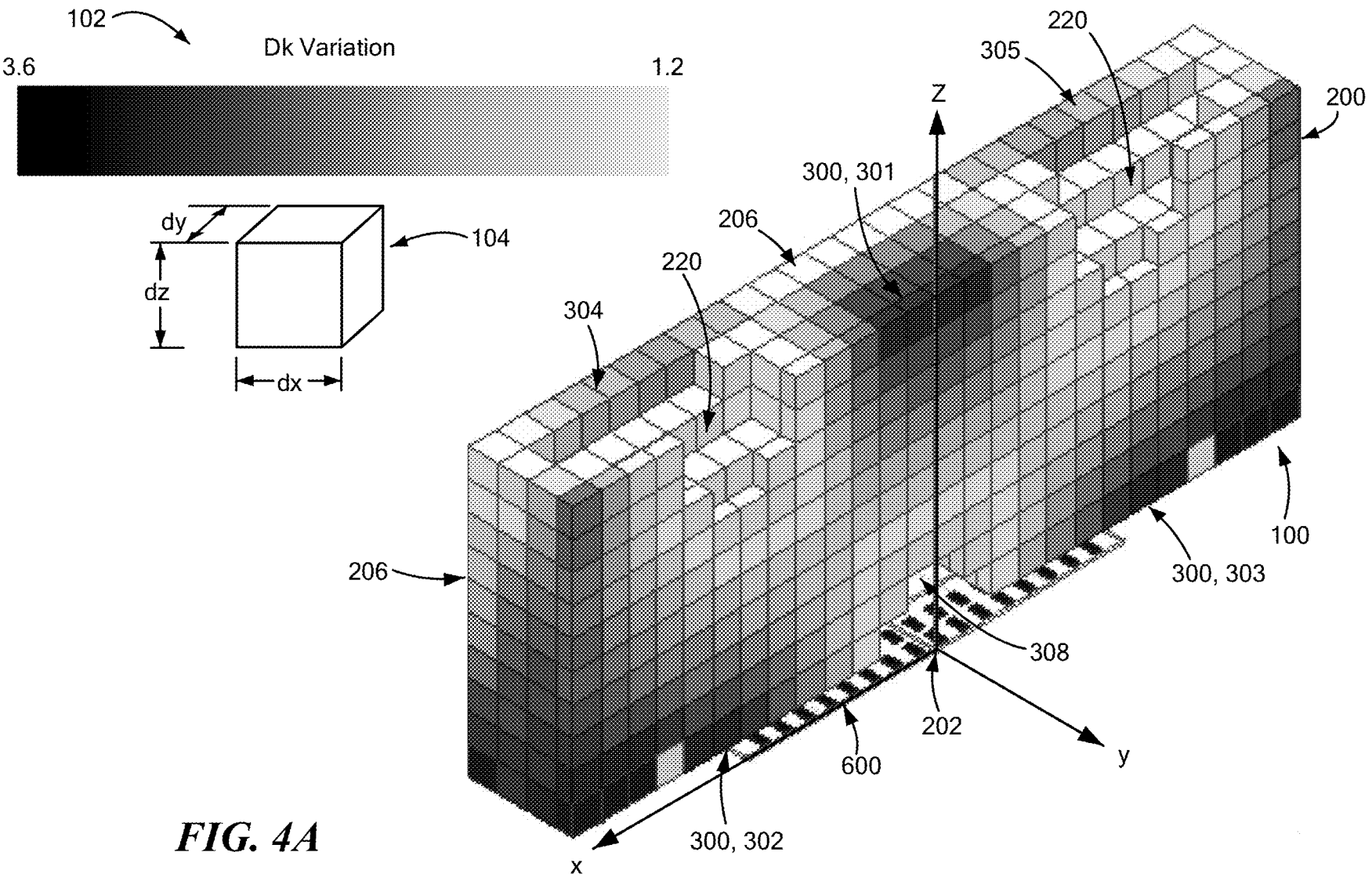
FIG. 4A depicts a rotated isometric view of the half-symmetry view of FIG. 1, in accordance with an embodiment.
Figure 4B:
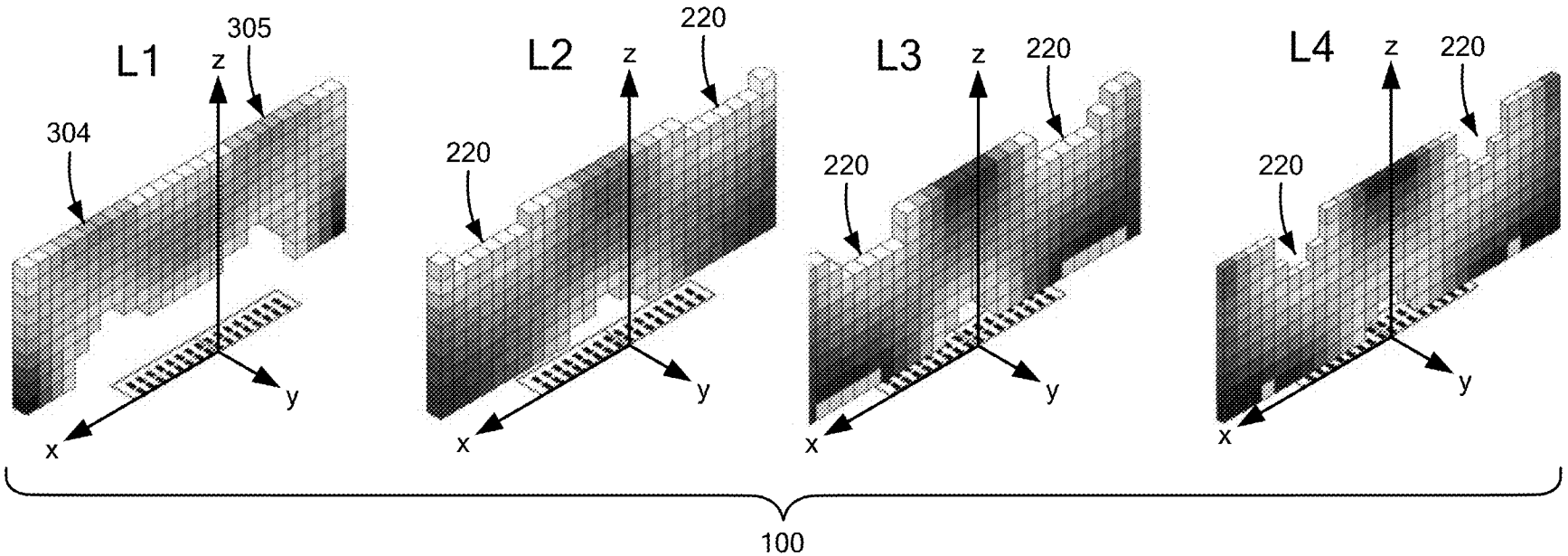
FIG. 4B depicts cross section slices L1-L4 of corresponding section cuts through the half-symmetry view depicted in FIG. 4A, in accordance with an embodiment.
Figure 4C:
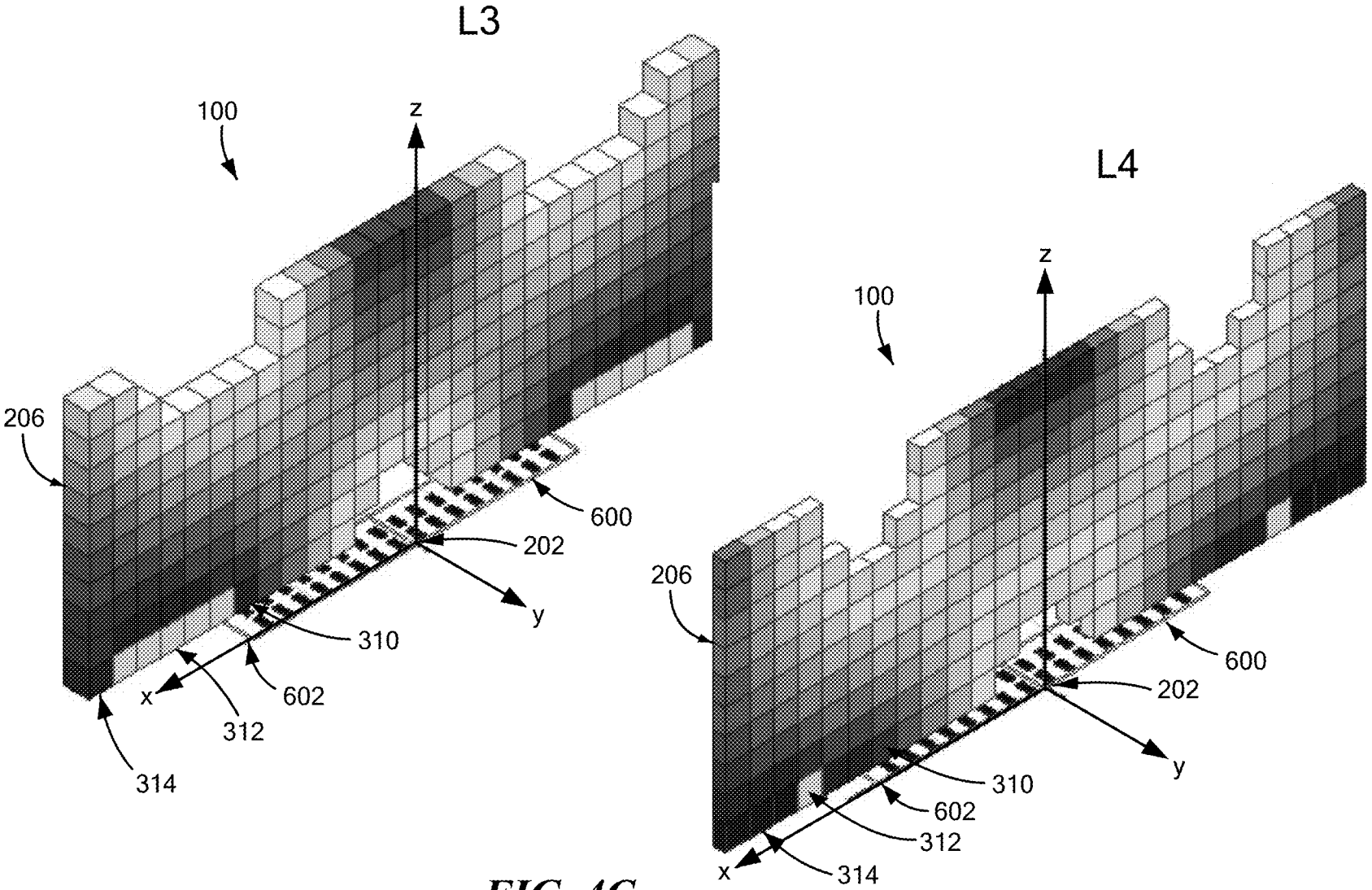
FIG. 4C depicts expanded views of cross section slices L3 and L4 of FIG. 4B, in accordance with an embodiment.
Figure 5:
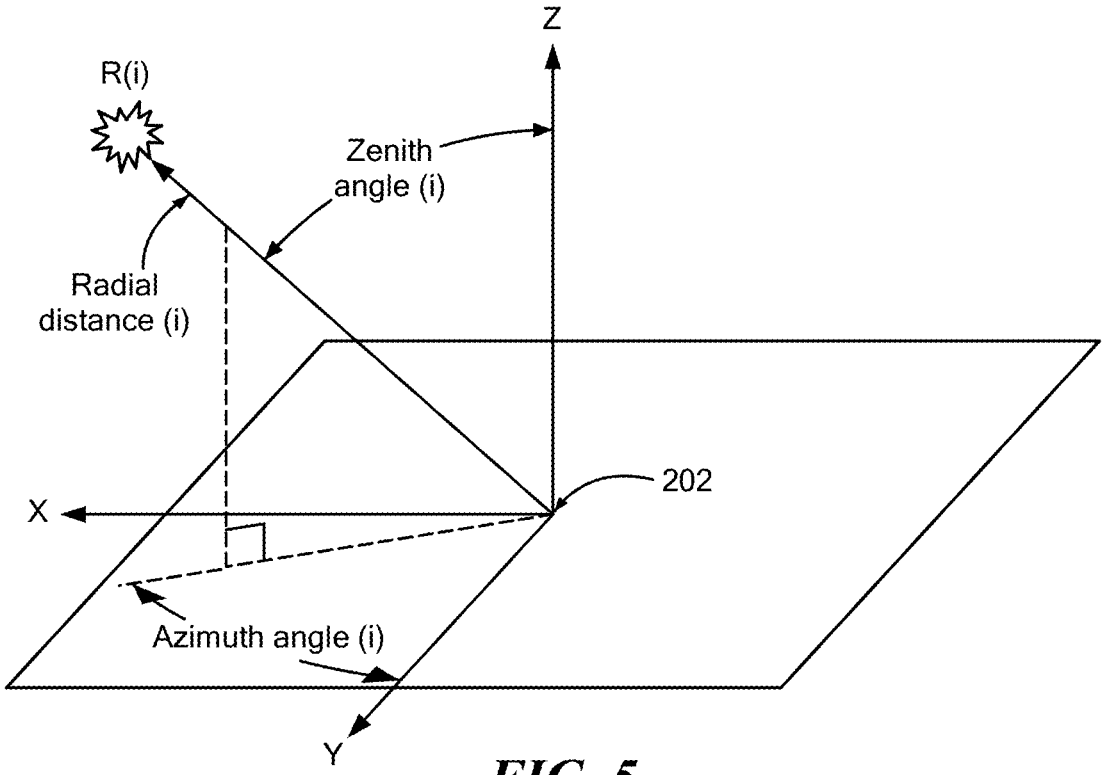
FIG. 5 depicts a representation of a spherical coordinate system as applied herein, in accordance with an embodiment.
Figure 6:
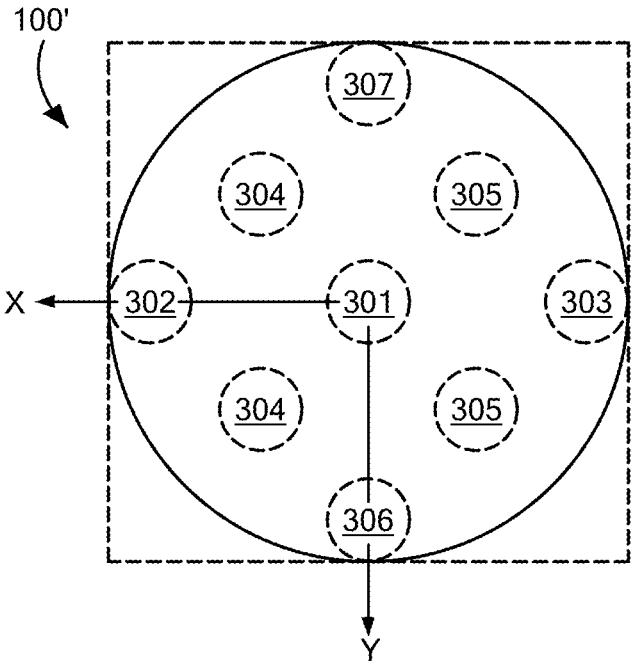
FIG. 6 depicts a transparent top down plan view of another example dielectric lens similar to but with a different shape and outer profile as compared to that of FIG. 1, in accordance with an embodiment.
Figure 7A:
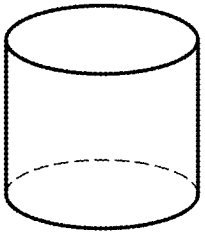
FIGS. 7A-7J depict in rotated isometric views example alternative 3D shapes for any lens disclosed herein, in accordance with an embodiment.
Figure 7B:
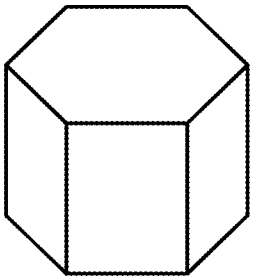
Figure 7C:
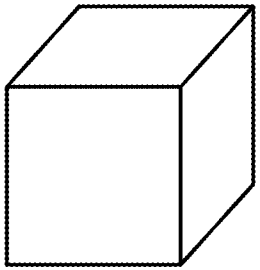
Figure 7D:
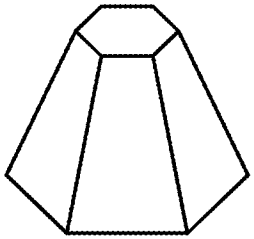
Figure 7E:
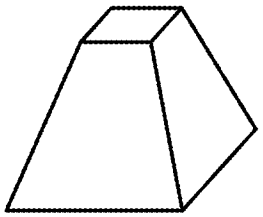
Figure 7F:
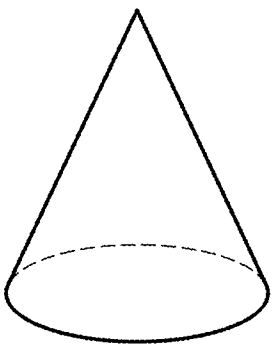
Figure 7G:
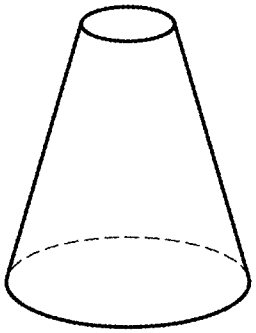
Figure 7H:
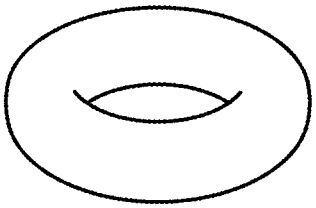
Figure 7I:
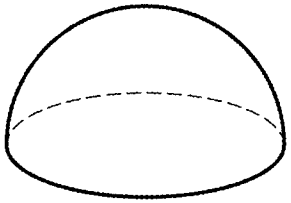
Figure 7J:
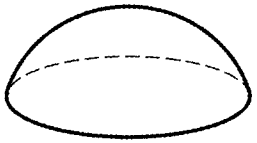
Figure 8A:
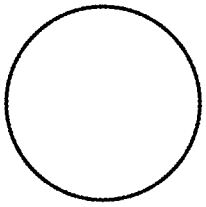
FIGS. 8A-8E depict example 2D x-y plane cross section views of the 3D shapes of FIGS. 7A-7J, in accordance with an embodiment; and, FIGS. 9A-9C depict in rotated isometric views representative alternative surfaces for use in accordance with an embodiment.
Figure 8B:
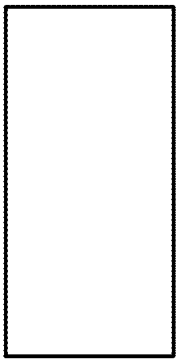
Figure 8C:
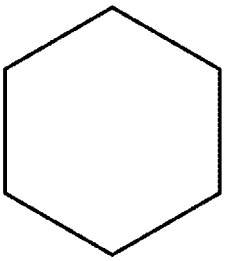
Figure 8D:
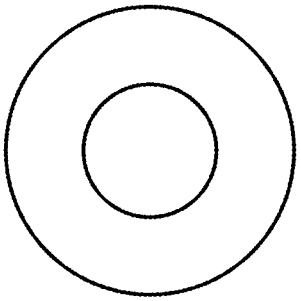
Figure 8E:
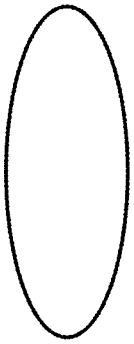
Figure 9A:
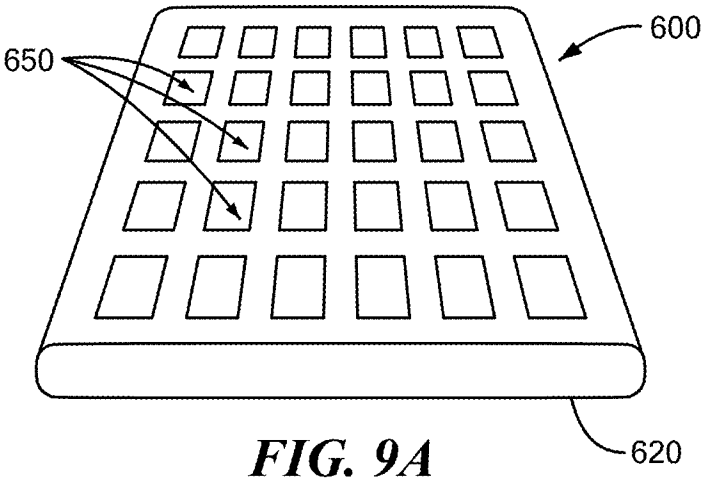
Figure 9C:
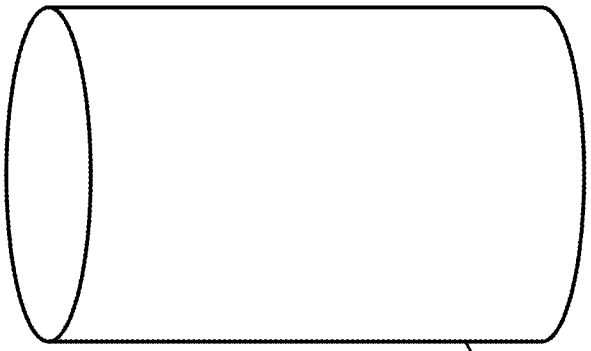

Reference is now made to FIGS. 1-9C, where: FIG. 1 depicts a rotated isometric view of a 3D block diagram analytical model of a dielectric lens representative of an example embodiment disclosed herein; FIGS. 2A and 2B depict a front cross section view of the embodiment of FIG. 1 cut through the x-z plane (herein referred to as a half-symmetry view); FIG. 3 depicts a top down plan view of the embodiment of FIG. 1; FIG. 4A depicts a rotated isometric view of a half-symmetry view of FIG. 1 (a thickness of 3½ block elements 104), also seen in FIGS. 2A and 2B, with a Dk scale 102 of example Dk values depicted, and with an example analytical block element 104 also depicted; FIG. 4B depicts cross section slices L1-L4 of corresponding consecutive section cuts through the half-symmetry view depicted in FIG. 4A; FIG. 4C depicts expanded views of cross section slices L3 and L4 of FIG. 4B; FIG. 5 depicts a representation of a spherical coordinate system as applied herein; FIG. 6 depicts a transparent top down plan view of another example dielectric lens similar to but with a different shape and outer profile as compared to that of FIG. 1; FIGS. 7A-7J depict example alternative 3D shapes for any lens disclosed herein; FIGS. 8A-8E depict example 2D x-y plane cross sections of the 3D shapes of FIGS. 7A-7J; and, FIGS. 9A-9C depict representative alternative surfaces for use in accordance with an embodiment disclosed herein. Regarding the example analytical block element 104 in the analytical model depicted in the various figures, each block element 104 has the following dimensions; dx=4.92 mm (millimeters), dy=5.26 mm, and dz=5.04 mm. Alternatively, each block element 104 has dx, dy, dz dimensions that are approximately 2λ/3, where λ is the wavelength at an operational frequency of 39 GHz (GigaHertz). However, such block element dimensions are for illustration or analytical purposes only, and are not limiting to a scope of the claimed invention in accordance with the appended claims. Regarding the cross section slices L1-L4, a comparison of FIG. 4B with FIG. 4A shows that slice L1 corresponds with the rear outer surface region 206 of the 3D body 200, half slice L4 corresponds with the x-z plane section cut of FIG. 4A, and slices L2 and L3 correspond with the intermediate regions between slice L1 and half slice L4. Regarding the Dk scale 102 depicted in FIG. 4A, an example embodiment includes a Dk variation with a relative dielectric constant that ranges from equal to or greater than 1.2 (depicted as light grey) to equal to or less than 3.6 (depicted as dark grey or black). However, it will be appreciated that this Dk variation is for analytical purposes only and is non-limiting to a scope of the claimed invention in accordance with the appended claims.

As can be seen in the several figures, both an orthogonal x-y-z coordinate system and a spherical coordinate system are depicted, and both will be referred to herein below for a more complete understanding of the subject matter disclosed herein. With respect to FIG. 2B, incremental +/− zenith angles are depicted in increments of 15 degrees.

An example dielectric lens 100 includes a three-dimensional, 3D, body 200 of dielectric material having a spatially varying Dk, where the 3D body 200 has at least three regions R(i) 300 (first, second, and third, regions R(1), R(2), and R(3), individually enumerated by reference numerals 301, 302, and 303, respectively) with local maxima of dielectric constant (relative permittivity) values Dk(i) relative to surrounding regions of respective ones of the at least three regions R(i) 300, where locations of the at least three regions R(i) 300 may be defined by local spherical coordinates of: azimuth angle(i), zenith angle(i), and radial distance(i), relative to a particular common point of origin 202 associated with the 3D body 200, where (i) is an index that ranges from 1 to at least 3 (illustration of a local spherical coordinate system best seen with reference to FIG. 5). The spatially varying Dk of the 3D body 200 is configured to vary as a function of the zenith angle Za between the region R(1) 301 and the region R(2) 302 at a given (constant) azimuth angle (the plane of FIG. 2A for example) and a given (constant) radial distance ra, which is best seen with reference to FIG. 2A. For example, and with reference to both FIG. 2A and FIGS. 4A-4C, and with particular reference to the Dk scale 102 depicted in FIG. 4A, it can be seen that the Dk value within the 3D body 200 varies from a relatively high value such as 3.6 for example at R(1) 301, to a relatively low value such as 1.2 for example in a region intermediate to R(1) 301 and R(2) 302, back to a relatively high value such as 3.6 for example at R(2) 302, as the zenith angle Za varies from 0 degrees to 90 degrees. As used herein and with reference to FIG. 5, the sign convention for the +/− azimuth angles is (plus) from the positive y-axis clockwise (CW) toward the positive x-axis (as observed in a top down plan view), and (negative) from the positive y-axis counterclockwise (CCW) toward the negative x-axis.

As used herein the phrase "relative to surrounding regions" means relative to the Dk of the dielectric medium of the 3D body 200 in close proximity to the respective region of local maxima of Dk, where the Dk of a corresponding surrounding region is lower than the associated region of local maxima of Dk, hence the term "local" maxima. In an embodiment, the corresponding surrounding region, in close proximity to the associated region of local maxima of Dk, completely surrounds the associated region of local maxima of Dk.

As used herein the phrase "a particular common point of origin 202" means a point relative to the 3D body 200 of the dielectric lens 100 that may suitably serve as a reference origin of a spherical coordinate system whereby the local coordinates of azimuth angle(i), zenith angle(i), and radial distance(i), of the at least three regions R(i) 300 may be determinable (see FIGS. 2A and 5 for example), or by a local x-y-z orthogonal coordinate system where the common point of origin 202 is the origin of the local x-y-z coordinate system. While FIGS. 2A and 2B depict the common point of origin 202 on an x-y plane that is substantially aligned with a bottom surface or base region 204 of the 3D body 200, it will be appreciated that such illustration is but only one example scenario, as other scenarios and structures falling with an ambit of the appended claims may involve a common point of origin being located internal or external to the 3D body 200.

In an embodiment and with particular reference to FIG. 2A, the given radial distance ra may be viewed as a first given radial distance, and the 3D body 200 may be further described with respect to a second varying radial distance rb that varies as a function of the zenith angle Zb. For example, the spatially varying Dk of the 3D body 200 is further configured to vary as a function of the zenith angle Zb between the region R(1) 301 and the region R(2) 302 at a given azimuth angle (the plane of FIG. 2A for example), and at a second varying radial distance rb that varies as a function of the zenith angle Zb, which is best seen with reference to FIG. 2A. As depicted in FIG. 2A, the varying radial distance rb increases as the zenith angle Zb increases from 0 degrees to 90 degrees. With reference to both FIG. 2A and FIGS. 4A-4C, and with particular reference to the Dk scale 102 depicted in FIG. 4A, it can be seen that the Dk value within an embodiment of the 3D body 200 varies from a relatively high value such as 3.6 for example at R(1) 301, to a relatively low value such as 1.2 for example in a region intermediate to R(1) 301 and R(4) 304, back to a relatively high value such as 2.4 for example at R(4) 304, to a relatively low value such as 1.2 for example in a region intermediate to R(4) 304 and R(2) 302, and back to a relatively high value such as 3.6 for example at R(2) 302, as the zenith angle Zb varies from 0 degrees to 90 degrees.

The above description of the spatially varying Dk values of the 3D body 200 has been described for zenith angles between 0 and 90 degrees and an azimuth angle of +90 degrees. However, and as can be seen in FIGS. 2A and 2B, a similar if not identical structure of the spatially varying Dk values of the 3D body 200 can be seen for zenith angles between 0 and 90 degrees and an azimuth angle of −90 degrees. That is, an embodiment of the 3D body 200 includes an arrangement with the spatially varying Dk values of the 2D body 200 are symmetrical with respect to the illustrated y-z plane, where the x-y-z origin is centrally disposed relative to the 3D body 200 as observed in a top down plan view of the 3D body 200 (see transitions of Dk values from R(1) 301 to R(5) 305 to R(3) 303 as a function of zenith angle Za from 0 to 90 degrees, and as a function of zenith angle Zb from 0 to 90 degrees, for example). As such and in view of the foregoing, it will be appreciated that an embodiment of the dielectric lens 100 also includes an arrangement where the spatially varying Dk of the 3D body 200 is configured to vary as a function of the zenith angle Za between the region R(1) 301 and a region R(3) 303 at a given azimuth angle (the plane of FIG. 2A for example) and a given (constant) radial distance ra. Additionally, it will be appreciated that an embodiment of the dielectric lens 100 also includes an arrangement where the spatially varying Dk of the 3D body 200 is configured such that region R(2) 302 and region R(3) 303, at corresponding azimuth angles that are 180-degrees apart, have Dks that are symmetrical with respect to each other, and/or with respect to region R(1) 301, relative to the y-z plane.

As can be seen in FIGS. 3 and 4A-4C, with reference to the Dk scale 102 in FIG. 4A, it will be further appreciated that an embodiment of the dielectric lens 100 includes an arrangement where the spatially varying Dk of the 3D body 200 is also configured to vary as a function of the azimuth angle (in the illustrated x-y plane for example, see also FIG. 5) between the region R(2) 302 and the region R(3) 303, at a given zenith angle (such as but not limited to 90 degrees for example) and a defined (fixed or variable) radial distance ra (fixed), rb (variable). For example and with reference to FIG. 4A and the Dk scale 102 therein, at a zenith angle of 90 degrees (i.e. the x-y plane) and a variable radial distance rb, the spatially varying Dk of the 3D body 200 varies from about 3.6 at region R(2) 302, to 1 (air) at an azimuth angle of +90 degrees clockwise from region R(2) 302, to about 3.6 at region R(3) 303, to 1 (air) at an azimuth angle −90 degrees clockwise from region R(3) 303, back to about 3.6 at region R(2) 302.

As can be seen in FIGS. 2A and 4A-4C, with reference to the Dk scale 102 in FIG. 4A, it will be further appreciated that an embodiment of the dielectric lens 100 includes an arrangement where the spatially varying Dk of the 3D body 200 is also configured to vary as a function of the radial distance between the common point of origin 202 and region R(1) 301, where in the embodiment illustrated in FIGS. 4A-4C the Dk value varies from about 1 (e.g., air) in a central region rc 308 proximate the common point of origin 202 gradually upward to about 3.6 at region R(1) 301. In general, an embodiment of the spatially varying Dk of the 3D body 200 is configured to vary gradually upward (i.e., increase) along at least one radial path as a function of the radial distance between the common point of origin 202 and at least one of the regions R(i) 300, such as the region R(1) 301 for example. In an embodiment, the spatially varying Dk of the 3D body 200 is configured to vary gradually upward along at least three different radial paths, having a common point of origin 202, as a function of the corresponding radial distance between the common point of origin 202 and at least one of the regions R(i) 300, such as the regions R(1) 301, R(2) 302, and R(3) 303, for example. While the embodiments depicted in FIGS. 1, 2A-2B and 4A-4C, illustrate the central region rc 308, and/or the region surrounding the common point of origin 202, being air or having a Dk equal to that of air, it will be appreciated that this is for illustration and/or modeling purpose only, and that the central region rc 308 and/or the region surrounding the common point of origin 202, may indeed be air or may be dielectric medium having a low Dk value close to that of air, such as a dielectric foam with air-filled open or closed cells for example. As such, it will be appreciated that the 3D body 200 at the common point of origin has a Dk value equal to or greater than that of air and equal to or less than 1.2.

As used herein the term "gradually" does not necessarily mean absent any step changes, such as may exist with the presence of layered shells of dielectric materials for example, but does mean at a rate across what may be a layered shell interface (or a transition zone) that does not exceed a change in Dk value of +/−1.9, more particularly +/−1.5, and even more particularly +/−1.0, from one region to an adjacent region of the 3D body 200 across the transition zone. As used herein, the distance across a transition zone from one region to an adjacent region of the 3D body 200 is measured relative to an operational wavelength of 1λ, and in an embodiment is measured relative to an operational wavelength of 0.5λ, where λ, is the operational wavelength in free space of an operational electromagnetic radiating signal having a defined operational frequency. That is, in an embodiment the distance across a transition zone from one region to an adjacent region of the 3D body 200 is 1λ, and in another embodiment is λ/2. In an embodiment, the defined operational frequency is 40 GHz.

Regarding the central region rc 308 and with reference to FIG. 2A, an embodiment includes an arrangement where the 3D body 200 for a defined radial distance rk 210 from the common point of origin 202 has a Dk value equal to or greater than that of air and equal to or less than 2, alternatively equal to or greater than that of air and equal to or less than 1.5, further alternatively equal to or greater than that of air and equal to or less than 1.2. In an embodiment, rk is equal to or less than 2λ, alternatively equal to or less than 1.5λ, alternatively equal to or less than 1λ, alternatively equal to or less than ⅔λ, or further alternatively equal to or less than ½λ.

In the embodiments depicted in FIGS. 1-4C, the radial path from the common point of origin 202 to the region R(1) 301 along the z-axis is also viewed as being a direction of the boresight of the dielectric lens 100 from a phased array antenna 600, when the phased array antenna 600 is electromagnetically excited, which will be discussed in more detail below.

With reference back to at least FIGS. 2A and 4A-4B, it will be appreciated that an embodiment of the dielectric lens 100 includes an arrangement where the spatially varying Dk of the 3D body 200 is also configured to vary as a function of the radial distance between the common point of origin 202 and region R(2) 302, and/or between the common point of origin 202 and region R(3) 303. For example, FIGS. 2A and 4A-4B both depict Dk values of the 3D body 200 varying between about 1 (air) at the common point of origin 202 and about 3.6 at region R(2) 302 and at region R(3) 303, as viewed in the x-y plane along both the +x axis and the −x axis.

In another embodiment and with reference still to at least FIGS. 2A and 4A-4B, the spatially varying Dk of the 3D body 200 is also configured to vary from the common point of origin 202 to the outer surface region 206 of the 3D body 200 in at least three different radial directions, such as but not limited to: along the +x-axis, along the −x-axis, along the +z-axis, for example.

As described herein above, the at least three regions R(i) 300 of the 3D body 200 with local maxima of dielectric constant values Dk(i) may include regions R(i) 300 in excess of three. For example and with particular reference to FIG. 2B (depicting zenith angles in 15 degree increments both CW and CCW relative to the z-axis as viewed in FIG. 2B) in combination with the several other figures disclosed herein, an embodiment includes an arrangement where region R(1) 301 is disposed at a zenith angle(1), Za1, between 15 degrees CCW and 15 degrees CW, region R(2) 302 is disposed at a zenith angle(2), Za2, between 75 degrees CCW and 90 degrees CCW, region R(3) 303 is disposed at a zenith angle(3), Za3, between 75 degrees CW and 90 degrees CW, region R(4) 304 is disposed at a zenith angle(4), Za4, between 15 degrees CCW and 75 degrees CCW, and/or region R(5) 305 is disposed at a zenith angle(5), Za5, between 15 degrees CW and 75 degrees CW. As can be seen by comparing FIGS. 2A-2B with FIGS. 1, 3, and 4A-4B, regions R(4) 304 and R(5) 305 are not in the same plane (the x-z plane for example) as regions R(1) 301, R(2) 302, and R(3) 303, but are "visible" in FIGS. 2A-2B due to the 3D analytical model of the dielectric lens 100 having internal air pockets 220 (best seen with reference to FIGS. 4A and 4B) proximate regions R(4) 304 and R(5) 305, resulting in regions R(4) 304 and R(5) 305 being visible when viewed from the x-z plane section cut of FIGS. 2A and 2*b*. In actuality it can be seen from the several figures that regions R(4) 304 and R(5) 305 are disposed in a plane parallel to and offset in the −y direction from the x-z plane. While the 3D analytical model of the dielectric lens 100 is described herein having the above noted air pockets 220, it will be appreciated that such pockets 220 may indeed be air or may be dielectric medium having a low Dk value close to that of air, such as a dielectric foam with air-filled open or closed cells for example.

With particular reference to FIGS. 4B-4C, it can be seen via the L1-L4 cross sections or slices that an embodiment also includes an arrangement where region R(2) 302 and region R(3) 303 are separated by an azimuth angle of about 180 degrees, and more generally by an azimuth angle of between 150 degrees and 180 degrees, and with particular reference to at least FIG. 1 it can also be seen that region R(4) 304 and region R(5) 305 are also separated by an azimuth angle of about 180 degrees, and more generally by an azimuth angle of between 150 degrees and 180 degrees.

In view of the foregoing and with reference to the several figures, particularly the Dk scale 102, it will be appreciated that an embodiment includes an arrangement where the spatially varying Dk of the 3D body 200 varies between greater than 1 and equal to or less than 15, alternatively varies between greater than 1 and equal to or less than 10, further alternatively varies between greater than 1 and equal to or less than 5, further alternatively varies between greater than 1 and equal to or less than 4. It will also be appreciated that an embodiment includes an arrangement where each region R(i) 300 having a corresponding local maxima of dielectric constant values Dk(i) has a Dk equal to or greater than 2 and equal to or less than 15, alternatively equal to or greater than 3 and equal to or less than 12, further alternatively equal to or greater than 3 and equal to or less than 9, further alternatively equal to or greater than 3 and equal to or less than 5. In an embodiment, the spatially varying Dk of the 3D body 200 of dielectric material varies gradually as a function of the azimuth angle(i), the zenith angle(i), and the radial distance(i). In an embodiment, the gradually varying Dk of the 3D body 200 of dielectric material changes at no more than a defined maximum Dk value per ¼ wavelength of the operating frequency, alternatively changes at no more than a defined maximum Dk value per ½ wavelength of the operating frequency, further alternatively changes at no more than a defined maximum Dk value per wavelength of the operating frequency. In an embodiment, the defined maximum Dk value is +/−1.9, more particularly +/−1.5, and even more particularly +/−1.0.

Reference is now made to FIG. 6 depicting a transparent top down plan view of another example dielectric lens 100' similar to but with a different shape and outer profile as compared to the dielectric lens 100 of FIG. 1. As can be seen, and in addition to regions R(1) 301, R(2) 302, and R(3) 303, and optional regions R(4) 304 and R(5) 305, of local maxima of dielectric constant values Dk(i), an embodiment includes an arrangement where the at least three regions R(i) 300 with local maxima of dielectric constant values Dk(i) further includes a region R(6) 306 and a region R(7) 307, with region R(1) 301 being disposed at a zenith angle(1) between −15 and +15 degrees (see FIG. 2B), and with regions R(2) 302, R(3) 303, R(6) 306, and R(7) 307, each being disposed at a zenith angle(2) that is either between −75 and −90 degrees, or between +75 and +90 degrees, as observed in the x-z plane or the y-z plane (with partial reference made to FIG. 2B). In an embodiment, regions R(2) 302 and R(3) 303 are separated by an azimuth angle between 150 and 180 degrees; regions R(6) 306 and R(7) 307 are separated by an azimuth angle between 150 and 180 degrees; regions R(2) 302 and R(6) 306 are separated by an azimuth angle between 30 and 90 degrees; regions R(3) 303 and R(6) 306 are separated by an azimuth angle between 30 and 90 degrees; regions R(2) 302 and R(7) 307 are separated by an azimuth angle between 30 and 90 degrees; and regions R(3) 303 and R(7) 307 are separated by an azimuth angle between 30 and 90 degrees. While FIG. 6 depicts a circular outer profile in solid line form for the dielectric lens 100', it will be appreciated that this is for illustration purposes only and that the dielectric lens 100' may have any shape suitable for a purpose disclosed herein, which is represented by the square outer profile in dashed line form that envelopes the circle in solid line form.

From all of the foregoing it will be appreciated that the various illustrated embodiments herein depicting various quantities and arrangements of regions R(i) 300 having local maxima of dielectric constant values Dk(i), are just a few examples of the many arrangements possible that are far too many to describe ad infinitum, yet are well within the purview of one skilled in the art. As such, all such embodiments of regions R(i) 300 falling within a scope of the appended claims are contemplated and considered to be fully and/or inherently disclosed herein by the representative examples presented herein.

Additionally, it will also be appreciated that while certain embodiments of the dielectric lens 100, 100' have been described and/or depicted having certain 2D and 3D shapes (rectangular block in FIG. 1, and circular or rectangular footprint in FIG. 6, for example), it will be appreciated that these are for illustration purposes only and that an embodiment of the invention disclosed herein is not so limited and extends to other 2D and 3D shapes such as those depicted in FIGS. 7A-7J and FIGS. 8A-8E, for example, without detracting from a scope of the disclosure. For example and with reference to FIGS. 7A-8E, any dielectric lens 100, 100' described herein may have a three-dimensional form in the shape of a cylinder FIG. 7A, a polygon box FIGS. 7B, 7C, a tapered polygon box FIGS. 7D, 7E, a cone FIG. 7F, a truncated cone FIG. 7G, a toroid FIG. 7H, a dome FIG. 7I (for example, a half-sphere), an elongated dome FIG. 7J, or any other three-dimensional form suitable for a purpose disclosed herein, and therefore may have a z-axis cross section in the shape of a circle FIG. 8A, a rectangle FIG. 8B, a polygon FIG. 8C, a ring FIG. 8D, an ellipsoid 8E, or any other shape suitable for a purpose disclosed herein.

In view of all of the foregoing, it will be appreciated that an alternative way of describing the dielectric lens 100 is by a dielectric lens 100 comprising: a three-dimensional, 3D, body 200 of dielectric material having a spatially varying Dk that varies along at least three different rays having different directions and a particular common point of origin 202, from the common point of origin 202 to an outer surface 206 of the 3D body 200, the particular common point of origin 202 being enveloped by the 3D body 200; wherein the at least three different rays (see FIG. 2A, ray ra through region R(1) 301 and region R(2) 302, and ray rb through region R(4) 304, for example) define locations of corresponding ones of at least three regions R(i) 300 (301, 302, 304) of the 3D body 200 with local maxima of dielectric constant values Dk(i) relative to the dielectric material of immediate surrounding regions of corresponding ones of the at least three regions R(i) 300; wherein the dielectric material of the 3D body 200 has a spatially varying Dk from each of the at least three regions R(i) 300 to any other one of the at least three regions R(i) 300 along any path within the 3D body 200 between the respective pairs of the at least three regions R(i) 300.

Reference is now made back to FIGS. 1 and 4A-4C, which in addition to all that is described and disclosed herein above also discloses an electromagnetic, EM, device 500 that includes a phased array antenna 600, and a dielectric lens 100 as disclosed herein above, where the dielectric lens 100 is configured and disposed to be in EM communication with the phased array antenna 600 when the phased array antenna 600 is electromagnetically excited. In an embodiment, the phased array antenna 600 is a planar phased array antenna, as depicted in at least FIGS. 1 and 4A-4C.

In an embodiment, the dielectric lens 100 is centrally disposed on top of the phased array antenna 600, as depicted in at least FIGS. 1 and 4A-4C.

In an embodiment, the dielectric lens 100 has a footprint as observed in a top-down plan view that is larger than a corresponding footprint of the phased array antenna 600, as depicted in at least FIGS. 1 and 4A-4C, such that the dielectric lens 100 extends beyond edges 602 of the phased array antenna 600 (best seen with reference to FIGS. 1 and 2A).

In an embodiment, portions of the dielectric lens 100 at a zenith angle of 90 degrees have a Dk value that increases then decreases then increases again along a specified radial direction from the common point of origin 202 outward beyond the edges 602 of the phased array antenna 600, such as along the +/−x axis (best seen with reference to FIGS. 4A-4C). For example, in cross section views L3 and L4 depicted in FIGS. 4B and 4C along the +x axis, the dielectric lens 100 has a Dk value that increases from about 1 or close to 1 at the common point of origin 202 (depicted here to be in a region of air), to a value of about 3.6 at region 310 proximate the edge 602 of the phased array antenna 600, then decreases to about 1.2 at region 312 beyond region 310 and the edge 602 of the phased array antenna 600, and then increases again to about 3.6 at region 314 beyond region 312 and further beyond the edge 602 of the phased array antenna 600. Stated alternatively, an embodiment of the lens 100 includes an arrangement where the 3D body 200 has a relatively high Dk region 314 outboard of a relatively low Dk region 312, which is outboard of a relatively high Dk region 310, which is outboard of a relatively low Dk region at the common point of origin 202, in a radial direction from a common point of origin 202 at a zenith angle of +/−90 degrees toward an outer surface 206 of the 3D body 200 for a given azimuth angle (in the x-z plane for example). While not being held to any particular theory, it is has been found through analytical modeling that the presence of a low Dk pocket, region 312 for example, just beyond the edge 602 of the phased array antenna 600 enhances the EM radiation pattern from the phased array antenna 600 for facilitating beam steering of the EM wavefront +/−90 degrees relative to a direction of propagation of the EM wavefront originating from the phased array antenna 600.

As described herein above, an embodiment of an EM device 500 includes the phased array antenna 600 being a planar phased array antenna, which is not only depicted in FIGS. 1 and 4A-4C, but is also depicted in FIG. 9A where individual antenna elements 650 are depicted in an example 5×6 array disposed on a planar substrate 620. As will be understood from the foregoing description of a dielectric lens 100, an embodiment as disclosed herein includes an arrangement where a single dielectric lens 100 is disposed to be in EM communication with the entire phased array antenna 600.

While embodiments described herein above refer to and illustrate a planar phased array antenna 600, it will be appreciated that embodiments disclosed herein are not so limited, and also encompass non-planar arrangements of phased array antennas, which will now be discussed with reference to FIGS. 9B-9C in combination with FIGS. 1-8E and 9A.

Figure 9B:
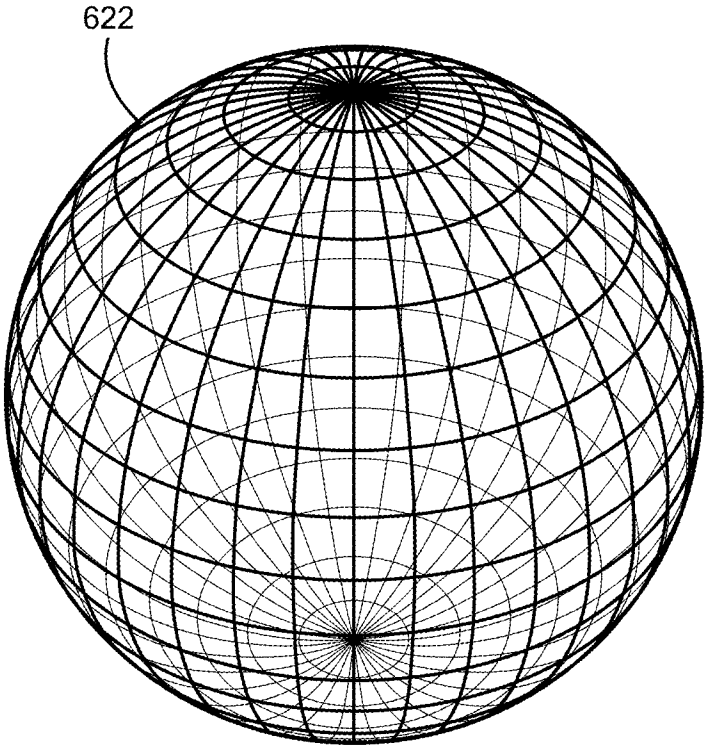

FIG. 9B depicts a non-planar substrate 622 in the form of a sphere, and FIG. 9C depicts a non-planar substrate 624 in the form of a cylinder. And while FIGS. 9B and 9C depict a complete sphere and a complete cylinder, respectively, it will be appreciated that a half-sphere and a half-cylinder are also contemplated. In an embodiment, an array of the individual antenna elements 650 may be strategically disposed on either the convex surface or the concave surface of the respective spherical substrate 622 or cylindrical substrate 624, and any form of the dielectric lens 100, 100' disclosed herein may be disposed over the array of antenna elements 650.

In an embodiment, each of the antenna elements 650 in the phased array antenna 600 can be operated with phase angle control or amplitude control, or alternatively operated with both phase angle control and amplitude control of the energizing signal so as to achieve optimum antenna system performance across the entire +/−90 degrees relative to a direction of propagation of the EM wavefront. In an embodiment, the +/−90 degree control relative to a direction of propagation may be relative to a horizontal axis or a vertical axis (see lens 100 in FIGS. 1-4C, for example), or both a horizontal and a vertical axis (see lens 100' in FIG. 6, for example).

Accordingly, it will be appreciated that an embodiment includes a phased array antenna that is a non-planar phased array antenna, where the non-planar phased array antenna has or is disposed on a spherical surface or a cylindrical surface. In an embodiment, the phased array antenna is configured to emit EM radiation from a convex side, a concave side, or both the convex side and the concave side, of the spherical surface toward the dielectric lens. In an embodiment, the phased array antenna is configured to emit EM radiation from a convex side, a concave side, or both the convex side and the concave side, of the cylindrical surface toward the dielectric lens.

While the foregoing description of a non-planar phased array antenna is made with reference to either a spherical or a cylindrical surface, it will be appreciated that a scope of the disclosure herein is not so limited, and also encompasses other non-planar surfaces, such as but not limited to a spheroidal, ellipsoidal, or hyperbolic surface for example. Any and all surfaces falling within an ambit of the appended claims are contemplated and considered to be inherently disclosed herein.

With respect to any of the foregoing descriptions of an EM device 500 having any form of substrate 620, 622, 624, with any arrangement of antenna elements 650 disposed thereon, and with any form of dielectric lens 100, 100' configured and disposed as disclosed herein, an embodiment of the EM device 500 is configured such that the phased array antenna 600 is configured and adapted to operate at a frequency range of equal to or greater than 1 GHz and equal to or less than 300 GHz, further alternatively equal to or greater than 10 GHz and equal to or less than 90 GHz, further alternatively equal to or greater than 20 GHz and equal to or less than 60 GHz, further alternatively equal to or greater than 20 GHz and equal to or less than 40 GHz. In an embodiment, the phased array antenna 600 is configured and adapted to operate at millimeter wave frequencies, and in an embodiment the millimeter wave frequencies are 5G millimeter wave frequencies.

While certain combinations of individual features have been described and illustrated herein, it will be appreciated that these certain combinations of features are for illustration purposes only and that any combination of any of such individual features may be employed in accordance with an embodiment, whether or not such combination is explicitly illustrated, and consistent with the disclosure herein. Any and all such combinations of features as disclosed herein are contemplated herein, are considered to be within the understanding of one skilled in the art when considering the application as a whole, and are considered to be within the scope of the invention disclosed herein, as long as they fall within the scope of the invention defined by the appended claims, in a manner that would be understood by one skilled in the art.

In view of all of the foregoing, it will be appreciated that some of the embodiments disclosed herein may provide one or more of the following advantages: an EM beam steering device that allows for beam steering of plus/minus 90 degrees with minimal drop in gain when place over a planar phased array antenna up to and including 5G mm wave frequencies; an EM beam steering device that allows for a radiation field coverage area to be increased with a decrease of ⅓ to ½ of the number of base station segments being needed; and, an EM dielectric lens having multiple separate focusing regions where there is a local maxima of dielectric constant value such that the lens refracts incident EM radiation constructively in conjunction with other focusing regions of the lens to achieve a given desired angle of radiation.

While an invention has been described herein with reference to example embodiments, it will be understood by those skilled in the art that various changes may be made and equivalents may be substituted for elements thereof without departing from the scope of the claims. Many modifications may be made to adapt a particular situation or material to the teachings of the invention without departing from the essential scope thereof. Therefore, it is intended that the invention not be limited to the particular embodiment or embodiments disclosed herein as the best or only mode contemplated for carrying out this invention, but that the invention will include all embodiments falling within the scope of the appended claims. In the drawings and the description, there have been disclosed example embodiments and, although specific terms and/or dimensions may have been employed, they are unless otherwise stated used in a generic, exemplary and/or descriptive sense only and not for purposes of limitation, the scope of the claims therefore not being so limited. When an element such as a layer, film, region, substrate, or other described feature is referred to as being "on" another element, it can be directly on the other element, or intervening elements may also be present. In contrast, when an element is referred to as being "directly on" another element, there are no intervening elements present. The use of the terms first, second, etc. do not denote any order or importance, but rather the terms first, second, etc. are used to distinguish one element from another. The use of the terms a, an, etc. do not denote a limitation of quantity, but rather denote the presence of at least one of the referenced item. The term "comprising" as used herein does not exclude the possible inclusion of one or more additional features. And, any background information provided herein is provided to reveal information believed by the applicant to be of possible relevance to the invention disclosed herein. No admission is necessarily intended, nor should be construed, that any of such background information constitutes prior art against an embodiment of the invention disclosed herein.

The invention claimed is:

1. A dielectric lens, comprising:

a three-dimensional, 3D, body of dielectric material having a spatially varying dielectric constant, Dk;

the 3D body having at least three regions R(i) with local maxima of dielectric constant values Dk(i) relative to surrounding regions of respective ones of the at least three regions R(i), locations of the at least three regions R(i) being defined by local coordinates of: azimuth angle(i), zenith angle(i), and radial distance(i), relative to a particular common point of origin associated with the 3D body, where (i) is an index that ranges from 1 to at least 3;

wherein the spatially varying Dk of the 3D body is configured to vary at least as a function of the zenith angle between a region R(1) and a region R(2) at a given azimuth angle and at a given radial distance.

2. The dielectric lens of claim 1, wherein the given radial distance is a first given radial distance, and further wherein:

the spatially varying Dk of the 3D body is further configured to vary as a function of the zenith angle between the region R(1) and the region R(2) at the given azimuth angle, and at a second varying radial distance that varies as a function of the zenith angle.

3. The dielectric lens of claim 1, wherein:

the spatially varying Dk of the 3D body is also configured to vary as a function of the zenith angle between the region R(1) and a region R(3) at a given azimuth angle and at a given radial distance; and the spatially varying Dk of the 3D body is also configured to vary as a function of the azimuth angle between the region R(2) and the region R(3), at a given zenith angle and at a given radial distance.

4. The dielectric lens of claim 1, wherein:

the spatially varying Dk of the 3D body is also configured to vary as a function of the radial distance between the particular common point of origin and R(1);

the spatially varying Dk of the 3D body is also configured to vary as a function of the radial distance between the particular common point of origin and R(2); and the spatially varying Dk of the 3D body is also configured to vary as a function of the radial distance between the particular common point of origin and R(3).

5. The dielectric lens of claim 1, wherein:

the 3D body has a base region and an outer surface region, and the particular common point of origin is proximate the base region.

6. The dielectric lens of claim 1, wherein:

R(2) and R(3), at corresponding azimuth angles that are 180-degrees apart, are symmetrical with respect to each other.

7. The dielectric lens of claim 1, wherein:

the 3D body at the particular common point of origin has a Dk equal to or greater than that of air and equal to or less than 1.2.

8. The dielectric lens of claim 1, wherein:

the 3D body for a defined radial distance rk from the particular common point of origin has a Dk equal to or greater than that of air and equal to or less than 2.

9. The dielectric lens of claim 8, wherein:

rk is equal to or less than ½ λ, where λ is the wavelength in free space of an operational electromagnetic radiating signal.

10. The dielectric lens of claim 9, wherein:

the operational electromagnetic radiating signal is operational at a frequency range of equal to or greater than 1 GHz and equal to or less than 300 GHz.

11. The dielectric lens of claim 1, wherein:

R(1) is disposed at a zenith angle(1) equal to or greater than 0 degrees and equal to or less than 15 degrees;

R(2) is disposed at a zenith angle(2) equal to or greater than 75 degrees and equal to or less than 90 degrees; and R(3) is disposed at a zenith angle(3) equal to or greater than 75 degrees and equal to or less than 90 degrees.

12. The dielectric lens of claim 1, further comprising:

a region R(4), wherein R(4) is disposed at a zenith angle(4) equal to or greater than 15 degrees and equal to or less than 75 degrees; and a region R(5), wherein R(5) is disposed at a zenith angle(5) equal to or greater than 15 degrees and equal to or less than 75 degrees.

13. The dielectric lens of claim 12, wherein:

R(2) and R(3) are separated by an azimuth angle equal to or greater than 150 degrees and equal to or less than 180 degrees; and R(4) and R(5) are separated by an azimuth angle equal to or greater than 150 degrees and equal to or less than 180 degrees.

14. The dielectric lens of claim 1, wherein:

the spatially varying Dk of the 3D body varies between greater than 1 and equal to or less than 15.

15. The dielectric lens of claim 1, wherein:

each local maxima of dielectric constant values Dk(i) of corresponding ones of the at least three regions R(i) has a Dk equal to or greater than 2 and equal to or less than 15.

16. The dielectric lens of claim 1, wherein:

the at least three regions R(i) with local maxima of dielectric constant values Dk(i) further comprises a region R(6) and a region R(7), with region R(1) being disposed at a zenith angle(1) equal to or greater than 0 and equal to or less than 15 degrees, and with regions R(2), R(3), R(6), and R(7), each being disposed at a zenith angle(2) that is either equal to or greater than +15 degrees and equal to or less than +90 degrees, or equal to or greater than −15 degrees and equal to or less than −90 degrees.

17. The dielectric lens of claim 16, wherein:

regions R(2) and R(3) are separated by an azimuth angle equal to or greater than 150 and equal to or less than 180 degrees;

regions R(6) and R(7) are separated by an azimuth angle equal to or greater than 150 and equal to or less than 180 degrees;

regions R(2) and R(6) are separated by an azimuth angle equal to or greater than 30 and equal to or less than 90 degrees;

regions R(3) and R(6) are separated by an azimuth angle equal to or greater than 30 and equal to or less than 90 degrees;

regions R(2) and R(7) are separated by an azimuth angle equal to or greater than 30 and equal to or less than 90 degrees; and regions R(3) and R(7) are separated by an azimuth angle equal to or greater than 30 and equal to or less than 90 degrees.

18. The dielectric lens of claim 1, wherein:

the spatially varying Dk of the 3D body of dielectric material varies gradually as a function of the azimuth angle(i), the zenith angle(i), and the radial distance(i);

the gradually varying Dk of the 3D body of dielectric material changes at no more than a defined maximum Dk value per ½ wavelength of an operating frequency; and the a defined maximum Dk value is +/−1.9.

19. An electromagnetic, EM, device, comprising:

a phased array antenna; and a dielectric lens according to claim 1;

wherein the dielectric lens is configured and disposed to be in EM communication with the phased array antenna when electromagnetically excited.

* * * * *